US011396406B2

(12) United States Patent
Guan et al.

(10) Patent No.: US 11,396,406 B2
(45) Date of Patent: Jul. 26, 2022

(54) MOBILE COOLING BOX WITH HINGE MODULE

(71) Applicant: Dometic Sweden AB, Solna (SE)

(72) Inventors: Weixian Guan, JinWan (CN); Peng Wang, JinWan (CN); Wenmin Tan, JinWan (CN); Yuelong Chen, JinWan (CN)

(73) Assignee: Dometic Sweden AB, Solna (SE)

( * ) Notice: Subject to any disclaimer, the term of this patent is extended or adjusted under 35 U.S.C. 154(b) by 229 days.

(21) Appl. No.: 16/728,657

(22) Filed: Dec. 27, 2019

(65) Prior Publication Data

US 2020/0216229 A1 Jul. 9, 2020

(30) Foreign Application Priority Data

Jan. 4, 2019 (DE) ..... 102019200070.3

(51) Int. Cl.
*B65D 43/16* (2006.01)
*F25D 3/08* (2006.01)
(Continued)

(52) U.S. Cl.
CPC ..... *B65D 43/165* (2013.01); *B65D 25/2841* (2013.01); *B65D 43/22* (2013.01); *F25D 3/08* (2013.01)

(58) Field of Classification Search
CPC .. B65D 43/165; B65D 43/164; B65D 43/163; B65D 43/16; B65D 43/22;
(Continued)

(56) References Cited

U.S. PATENT DOCUMENTS 1,691,468 A * 11/1928 Cooper ..... E05D 7/1077 220/842
2,012,800 A * 8/1935 Allen ..... E05D 7/1005 220/844
(Continued)

FOREIGN PATENT DOCUMENTS

AU 201712770 5/2017
AU 201712777 5/2017
(Continued)

OTHER PUBLICATIONS

Examination Report Issued for DE Application No. 102020209896.4 dated Apr. 19, 2021.
(Continued)

*Primary Examiner* — Robert J Hicks
(74) *Attorney, Agent, or Firm* — Middleton Reutlinger

(57) ABSTRACT

A mobile cooling box having a box main body and at least one lid for opening the box and providing access to the inside of the box. The at least one lid is pivotally attached to the box main body by at least two hinge modules. Each hinge module comprises a pin module having a hinge pin with a front end, a rear end, a longitudinal axis about which the lid is pivotable and predominantly a smooth outer surface of a cylindrical shape. Each hinge module further comprises a bearing module having a hinge bearing accommodating the hinge pin. The hinge pin laterally extends with its front end into the hinge bearing. A bolt portion extends from the rear end of the hinge pin so that so that the pin module is mountable by the bolt portion.

19 Claims, 17 Drawing Sheets

(51) Int. Cl.
*B65D 43/22* (2006.01)
*B65D 25/28* (2006.01)

(58) Field of Classification Search
CPC ..... B65D 25/2841; B65D 25/2838; B65D 25/2835; B65D 25/28; A45C 11/20; F25D 3/08; F25D 3/06; F25D 3/02
USPC ..... 220/592.03, 592.02, 915.2, 915.1, 844, 220/843, 848, 836, 810; 62/457.7, 457.2, 62/457.1
See application file for complete search history.

(56) References Cited

U.S. PATENT DOCUMENTS 2,492,601 A 12/1949 Steel
2,642,728 A 6/1953 Thomaras
2,715,817 A 8/1955 Brodheim
2,766,901 A * 10/1956 Sunko ..... E05D 5/10 220/844
2,926,504 A 3/1960 Hellinger
3,796,063 A 3/1974 Wulke et al.
D256,587 S 8/1980 Tatsumi
4,468,932 A 9/1984 Bullard
4,886,176 A 12/1989 Steakley
5,301,508 A 4/1994 Kahl et al.
5,319,937 A 6/1994 Fritsch et al.
D349,007 S * 7/1994 Costello ..... D7/605
5,407,218 A 4/1995 Jackson
5,676,296 A 10/1997 Masters
5,860,281 A 1/1999 Coffee et al.
5,897,435 A 4/1999 Thomas et al.
6,027,249 A 2/2000 Bielinski
6,308,518 B1 10/2001 Hunter
6,349,845 B1 2/2002 Duncan
6,354,101 B1 * 3/2002 Levitin ..... F28D 5/00 62/274
6,354,104 B1 3/2002 Feagin
6,474,097 B2 11/2002 Treppedi et al.
D497,517 S 10/2004 Reuter
D500,057 S 12/2004 Reuter
D516,099 S 2/2006 Maruyama
7,143,601 B1 12/2006 Jimenez
D534,771 S 1/2007 Zorn
7,178,673 B1 2/2007 Miller
7,415,794 B1 8/2008 Thompson
7,617,699 B1 11/2009 Parmely
7,913,849 B2 3/2011 Pedrazzi et al.
D640,102 S 6/2011 Hawkins
8,210,819 B2 7/2012 Wiebe et al.
8,312,816 B2 11/2012 Vaccarella
D712,720 S 9/2014 Seiders
D712,721 S 9/2014 Seiders
D712,722 S 9/2014 Seiders
D712,723 S 9/2014 Seiders
D714,125 S 9/2014 Seiders
8,910,819 B2 12/2014 Seiders
D722,474 S 2/2015 Seiders
D722,475 S 2/2015 Seiders
D732,348 S 6/2015 Seiders et al.
D732,349 S 6/2015 Seiders et al.
D732,350 S 6/2015 Seiders et al.
D732,899 S 6/2015 Seiders et al.
9,137,232 B2 9/2015 Eschbatch et al.
9,139,352 B2 9/2015 Seiders et al.
9,163,871 B1 10/2015 Costello
9,187,232 B2 11/2015 Seiders
9,220,250 B1 12/2015 Davis, Sr.
9,232,290 B2 1/2016 Besay
D752,347 S 3/2016 Seiders et al.
9,282,797 B1 3/2016 Soto
9,320,938 B1 4/2016 Belmore
D792,486 S 7/2017 Li
D802,028 S 11/2017 Li
D802,029 S 11/2017 Li
D802,630 S 11/2017 Li
9,951,986 B1 4/2018 Turner
D820,049 S 6/2018 Ahlstrom
D836,993 S 1/2019 Meda
D836,994 S 1/2019 Meda
D844,386 S 4/2019 Ahlstrom
D887,788 S 6/2020 Meda
D888,503 S 6/2020 Meda
10,717,499 B1 * 7/2020 Street ..... B65D 25/22
D894,043 S 8/2020 Meda
D901,986 S 11/2020 Meda
D920,743 S 6/2021 Meda et al.
D927,938 S 8/2021 Meda et al.
D929,471 S 8/2021 Meda et al.
D935,280 S 11/2021 Thelin et al.
2002/0095947 A1 7/2002 Treppedi et al.
2005/0274726 A1 12/2005 Boggs et al.
2005/0279750 A1 12/2005 Barquist et al.
2007/0101754 A1 * 5/2007 Maldonado ..... B67D 3/0067 62/389
2009/0126419 A1 5/2009 Yoon et al.
2010/0251730 A1 10/2010 Whillock, Sr.
2011/0226785 A1 9/2011 Sakell
2015/0008242 A1 1/2015 Kpabar, Jr.
2015/0021106 A1 1/2015 LaRosa
2015/0114024 A1 4/2015 Grepper
2015/0241107 A1 8/2015 Mech
2015/0322698 A1 11/2015 Seiders
2015/0353263 A1 12/2015 Seiders et al.
2016/0101924 A1 4/2016 Mitchell et al.
2016/0187046 A1 6/2016 Chen et al.
2017/0023290 A1 1/2017 DeMuth
2017/0108253 A1 4/2017 Monroy
2018/0100682 A1 * 4/2018 Nilsen ..... F25D 11/006
2018/0141718 A1 5/2018 Ahlstrom
2018/0201432 A1 7/2018 Harding
2018/0306479 A1 10/2018 Vazquez
2019/0161240 A1 5/2019 Ahlstrom
2019/0308795 A1 10/2019 Juneau
2020/0062454 A1 2/2020 Duong et al.
2020/0216229 A1 7/2020 Weixian
2020/0217571 A1 7/2020 Weixian
2020/0217574 A1 7/2020 Thelin
2020/0217575 A1 7/2020 Thelin
2020/0217576 A1 7/2020 Weixian
2020/0217578 A1 7/2020 Wang

FOREIGN PATENT DOCUMENTS

AU 201712780 5/2017
AU 201712782 5/2017
AU 201712791 5/2017
AU 201712799 5/2017
AU 201712802 5/2017
AU 201712803 5/2017
AU 201712785 7/2017
AU 201716789 11/2017
AU 201716791 11/2017
AU 201717667 1/2018
AU 201717669 1/2018
AU 201717670 1/2018
AU 201717674 1/2018
AU 201717676 1/2018
AU 201717662 2/2018
AU 201816061 1/2019
AU 201910011 2/2019
AU 201913598 8/2019
AU 201913601 8/2019
AU 201913603 8/2019
AU 201913604 8/2019
AU 201913607 8/2019
AU 201913624 8/2019
AU 201913626 8/2019
AU 201913627 8/2019
AU 201913631 8/2019
AU 201913633 8/2019
AU 202012545 6/2020
AU 202012548 6/2020
AU 2019284128 7/2020

(56) References Cited

FOREIGN PATENT DOCUMENTS

| | | | |
|---|---|---|---|
| AU | 2019284129 | | 7/2020 |
| AU | 2019284130 | | 7/2020 |
| AU | 2019284131 | | 7/2020 |
| AU | 2019284133 | | 7/2020 |
| AU | 2019284134 | | 7/2020 |
| CN | 101074057 | A | 11/2007 |
| CN | 206488529 | U | 9/2017 |
| CN | 107804580 | A | 3/2018 |
| CN | 207081259 | U | 3/2018 |
| CN | 208312853 | U | 1/2019 |
| CN | 106233083 | | 7/2019 |
| CN | 305240920 | S | 7/2019 |
| CN | 110191654 | | 8/2019 |
| CN | 209893773 | U | 1/2020 |
| CN | 305553099 | | 1/2020 |
| CN | 305751278 | | 5/2020 |
| CN | 306079204 | | 9/2020 |
| DE | 666767 | C | 10/1938 |
| DE | 20110247 | | 12/2002 |
| DE | 202004010081 | | 9/2004 |
| DE | 19981898 | B3 | 7/2005 |
| DE | 202007001638 | | 5/2007 |
| DE | 202009015164 | | 3/2010 |
| DE | 102011100722 | U1 | 11/2012 |
| DE | 202014000386 | U1 | 4/2014 |
| DE | 202013007655 | | 1/2015 |
| DE | 102019200065 | | 1/2019 |
| DE | 102019200067 | | 1/2019 |
| DE | 102019200068 | | 1/2019 |
| DE | 102019200070 | | 1/2019 |
| DE | 112017005901 | | 8/2019 |
| DE | 102019200063 | | 7/2020 |
| DE | 102019200064 | | 7/2020 |
| EM | 005230802-001 | | 4/2018 |
| EM | 005230802-002 | | 4/2018 |
| EM | 001470413-0001-02 | | 1/2019 |
| EM | 005948601-0001-30 | | 1/2019 |
| EP | 2772704 | A1 | 9/2014 |
| GB | 432256 | A | 7/1935 |
| GB | 2419177 | A | 4/2006 |
| JP | H1194417 | A | 4/1999 |
| KR | 1020050042093 | A | 5/2005 |
| WO | 9936324 | A1 | 7/1999 |
| WO | 2014131679 | A1 | 9/2014 |
| WO | 2017071654 | A1 | 5/2017 |
| WO | 2018095957 | | 5/2018 |
| WO | 2018231826 | A1 | 12/2018 |
| WO | 2018233611 | A1 | 12/2018 |
| WO | 2019206219 | A1 | 10/2019 |

OTHER PUBLICATIONS

Corrected Notice of Allowance Issued in U.S. Appl. No. 29/697,070 dated May 19, 2021.
Design U.S. Appl. No. 29/785,568, filed May 26, 2021 titled "Cooler Fender Frame".
Non Final Office Action Issued in U.S. Appl. No. 16/728,715 dated May 19, 2021.
Corrected Notice of Allowance for U.S. Appl. No. 29/697,070 dated Jun. 3, 2021.
Corrected Notice of Allowance for U.S. Appl. No. 29/697,071 dated Jun. 3, 2021.
Design U.S. Appl. No. 29/585,279, filed Nov. 22, 2016 titled Latch.
Design U.S. Appl. No. 29/605,186, filed May 24, 2017 filed titled Refrigerating Apparatus.
Design U.S. Appl. No. 29/650,906, filed Jun. 11, 2018 titled Soft Bag Cooler.
Design U.S. Appl. No. 29/670,885, filed Nov. 20, 2018 titled Cooler.
Design U.S. Appl. No. 29/670,888, filed Nov. 20, 2018 titled Cooler.
Design U.S. Appl. No. 29/697,069, filed Jul. 3, 2019 titled Cooler.
Design U.S. Appl. No. 29/697,070, filed Jul. 3, 2019 titled Cooler.
Design U.S. Appl. No. 29/697,071, filed Jul. 3, 2019 titled Cooler.
Design U.S. Appl. No. 29/708,155, filed Oct. 3, 2019 titled Latch.
Design U.S. Appl. No. 29/708,156, filed Oct. 3, 2019 titled Latch.
Design U.S. Appl. No. 29/711,905, filed Nov. 4, 2019 titled Cover for a Cooler.
Design U.S. Appl. No. 29/711,906, filed Nov. 4, 2019 titled Cover for a Cooler.
U.S. Appl. No. 16/728,646, filed Dec. 27, 2019 titled Mobile Cooling Box with Air Vents.
U.S. Appl. No. 16/728,604, filed Dec. 27, 2019 titled Mobile Cooling Box with Handle Module.
U.S. Appl. No. 16/728,715, filed Dec. 27, 2019 titled Mobile Cooling Box with Ice Maker.
U.S. Appl. No. 16/728,687, filed Dec. 27, 2019 titled Mobile Cooling Box with Latch Handle.
U.S. Appl. No. 16/728,623, filed Dec. 27, 2019 titled Mobile Cooling Box with User Interface Module.
U.S. Appl. No. 16/800,512, filed Feb. 25, 2020 titled Cover for a Cooler.
Design U.S. Appl. No. 29/743,180, filed Jul. 20, 2020 titled Cooler.
Dometic Product Catalog—Coolers; 2015.
Dometic Product Catalog—Coolers; 2016.
United States Patent Office, Notice of Allowance in U.S. Appl. No. 29/697,070 dated Apr. 28, 2021.
Restriction Requirement for Design U.S. Appl. No. 29/697,070 dated Dec. 28, 2020.
Notice of Allowance Issued in U.S. Appl. No. 29/697,071 dated Dec. 23, 2020.
Examination report mailed in EU Design Application No. 005948601-0001/005948601-0030 dated Jan. 9, 2019.
Examination report mailed in DE Patent Application No. 102019200070.3 dated Sep. 24, 2019.
Examination report mailed in DE Patent Application No. 102019200064.9 dated Sep. 27, 2019.
Examination report mailed in DE Patent Application No. 102019200067.3 dated Oct. 8, 2019.
Examination report mailed in DE Patent Application No. 102019200063.0 dated Oct. 15, 2019.
Notification to Grant Patent Right for CN Design Application No. 201930331393.8 dated Oct. 29, 2019.
CN Design application No. 201930331393.8 entitled "Cooler" filed on Jun. 25, 2019.
CN Patent Application No. 201911066985.7 entitled "Cover for a Cooler" filed Nov. 4, 2019.
DE Design Application No. 102019200067.3 entitled "Mobile Cooling Box With Ice Maker" filed Jan. 4, 2019.
DE Patent Application No. 102019200063.0 entitled "Mobile Cooling Box with User Interface Module" filed Jan. 4, 2019.
DE Patent Application No. 102019200064.9 entitled "Mobile Cooling Box with Latch Handle Opening" filed Jan. 4, 2019.
DE Patent Application No. 102019200070.3 entitled "Mobile Cooling Box With Hinge Module" filed Jan. 4, 2019.
European Design Application No. 005948601 "Cooler" filed Jan. 4, 2019.
Design U.S. Appl. No. 29/666,264 entitled "Cooler" filed Oct. 11, 2018.
Design U.S. Appl. No. 29/650,910, filed Jun. 11, 2018 titled "Zipper Pull".
AU Patent Application No. 202012545 entitled "Cover for Cooler" filed May 1, 2020.
AU Patent Application No. 202012548 entitled "Cover for Cooler" filed Apr. 30, 2020.
European Design Application No. 007847777-0002 "CFX3 Protective covers" filed Apr. 30, 2020.
Decision to Grant mailed in DE Patent Application No. 102019200064.9 dated Jul. 31, 2020.
Decision to Grant mailed in DE Patent Application No. 102019200063.0 dated Aug. 4, 2020.
Restriction Requirement for Design U.S. Appl. No. 29/697,069 dated Sep. 24, 2020.
AU Patent Application No. 2019284133 entitled "Mobile cooling box with ice maker" filed Dec. 30, 2019.
AU Patent Application No. 2019284131 entitled "Mobile cooling box with hinge moduler" filed Dec. 30, 2019.

(56) References Cited

OTHER PUBLICATIONS

AU Patent Application No. 2019284128 entitled "Mobile cooling box with user interface moduler" filed Dec. 30, 2019.
AU Patent Application No. 2019284134 entitled "Mobile Cooling Box with Latch Handle Opening" filed Dec. 30, 2019.
Notice of Allowance Issued in U.S. Appl. No. 29/697,069 dated Feb. 1, 2021.
Corrected Notice of Allowance Issued in U.S. Appl. No. 29/711,905 dated Aug. 11, 2021.
Corrected Notice of Allowance Issued in U.S. Appl. No. 29/711,906 dated Aug. 11, 2021.
Restriction Requirement Issued in U.S. Appl. No. 16/728,623 dated Aug. 30, 2021.
Design U.S. Appl. No. 29/803,817 titled "Fender Frame, Internal Closure, and Hinge of a Cooler" filed Aug. 16, 2021.
Decision to Grant mailed in DE Patent Application No. 1020192000681 dated Oct. 15, 2020.
Examination report mailed in DE Application No. 102019200065.7 dated Sep. 30, 2019.
Examination report mailed in DE Application No. 102019200068.1 dated Oct. 8, 2019.
DE Patent application 102020209896.4 entitled "Handle Module" filed on Aug. 5, 2020.
Decision to Grant mailed in DE Patent Application No. 102019200065.7 dated Aug. 4, 2020.
Corrected Notice of Allowance Issued in U.S. Appl. No. 29/697,069 dated Feb. 26, 2021.
Notice of Allowance Issued in U.S. Appl. No. 29/697,071 dated Apr. 12, 2021.
Amazon.com, ICECO insulated protective cover, first date available Oct. 11, 2019. (Year: 2019), pp. 1-2.
Corrected Notice of Allowance Issued in U.S. Appl. No. 29/697,070 dated Jun. 9, 2021.
Corrected Notice of Allowance Issued in U.S. Appl. No. 29/697,071 dated Jun. 9, 2021.
Notice of Allowance Issued in U.S. Appl. No. 29/711,905 dated Jul. 12, 2021.
Notice of Allowance Issued in U.S. Appl. No. 29/711,906 dated Jul. 12, 2021.
Corrected Notice of Allowance Issued in U.S. Appl. No. 29/711,905 dated Sep. 24, 2021.
Corrected Notice of Allowance Issued in U.S. Appl. No. 29/711,906 dated Sep. 24, 2021.
Final Office Action Issued in U.S. Appl. No. 16/728,715 dated Oct. 7, 2021.
Non Final Office Action Issued in U.S. Appl. No. 16/728,604 dated Oct. 25, 2021.
Notice of Allowance Issued in U.S. Appl. No. 29/785,568 dated Nov. 16, 2021.
Corrected Notice of Allowance Issued in U.S. Appl. No. 29/785,568 dated Dec. 6, 2021.
United Kingdom Application No. 6157637 titled "Mini Fridge" filed on Aug. 27, 2021.
United Kingdom Application No. 6157638 titled "Mini Fridge" filed on Aug. 27, 2021.
United Kingdom Application No. 6157639 titled "Mini Fridge" filed on Aug. 27, 2021.
United Kingdom Application No. 6157640 titled "Mini Fridge" filed on Aug. 27, 2021.
United Kingdom Application No. 6157641 titled "Mini Fridge" filed on Aug. 27, 2021.
United Kingdom Application No. 6157642 titled "Mini Fridge" filed on Aug. 27, 2021.
United Kingdom Application No. 6157643 titled "Mini Fridge" filed on Aug. 27, 2021.
United Kingdom Application No. 6157644 titled "Mini Fridge" filed on Aug. 27, 2021.
United Kingdom Application No. 6157645 titled "Mini Fridge" filed on Aug. 27, 2021.
United Kingdom Application No. 6157646 titled "Mini Fridge" filed on Aug. 27, 2021.
United Kingdom Application No. 6157647 titled "Mini Fridge" filed on Aug. 27, 2021.
United Kingdom Application No. 6157648 titled "Mini Fridge" filed on Aug. 27, 2021.
United Kingdom Application No. 6157649 titled "Mini Fridge" filed on Aug. 27, 2021.
United Kingdom Application No. 6157650 titled "Mini Fridge" filed on Aug. 27, 2021.
United Kingdom Application No. 6157651 titled "Mini Fridge" filed on Aug. 27, 2021.
United Kingdom Application No. 6157652 titled "Mini Fridge" filed on Aug. 27, 2021.
United Kingdom Application No. 6157653 titled "Mini Fridge" filed on Aug. 27, 2021.
United Kingdom Application No. 6157654 titled "Mini Fridge" filed on Aug. 27, 2021.
United Kingdom Application No. 6157655 titled "Mini Fridge" filed on Aug. 27, 2021.
United Kingdom Application No. 6157656 titled "Mini Fridge" filed on Aug. 27, 2021.
Office Action Issued in German Patent Application No. 102019200070.3 dated Aug. 25, 2021.
Office Action Issued in U.S. Appl. No. 16/728,646 dated Dec. 21, 2021.
Notice of Allowance Issued in U.S. Appl. No. 16/728,715 dated Feb. 2, 2022.
Notice of Allowance Issued in U.S. Appl. No. 29/785,568 dated Feb. 8, 2022.
Notice of Allowance Issued in U.S. Appl. No. 29/711,906 dated Feb. 7, 2022.
Decision to Grant Issued in German Application No. 102019200070.3 dated Mar. 2, 2022.
Corrected Notice of Allowance Issued in U.S. Appl. No. 16/728,715 dated Feb. 23, 2022.
Supplemental Notice of Allowance Issued in U.S. Appl. No. 29/711,906 dated Mar. 10, 2022.
Notice of Allowance Issued in U.S. Appl. No. 29/785,568 dated Mar. 9, 2022.
Corrected Notice of Allowance Issued in U.S. Appl. No. 16/728,715 dated Mar. 9, 2022.
Notice of Allowance Issued in U.S. Appl. No. 16/728,604 dated Apr. 13, 2022.
Non Final Office Action Issued in U.S. Appl. No. 16/728,687 dated Apr. 15, 2022.
Corrected Notice of Allowance Issued in U.S. Appl. No. 29/711,906 dated May 2, 2022.
Notice of Allowance Issued in U.S. Appl. No. 16/728,604 dated May 13, 2022.
Corrected Notice of Allowance Issued in U.S. Appl. No. 16/728,715 dated May 16, 2022.
Restriction Requirement Issued in U.S. Appl. No. 16/800,512 dated May 24, 2022.
U.S. Appl. No. 17/825,374 titled "Mobile Cooling Box with Ice Maker" filed May 26, 2022.
Design U.S. Appl. No. 29/840,161 titled "Cooler Fender Frame" filed May 26, 2022.
Non-Final Office Action Issued in U.S. Appl. No. 16/728,646 dated May 26, 2022.

* cited by examiner

MOBILE COOLING BOX WITH HINGE MODULE

The present embodiments relate to an improved mobile cooling box with a lid that is pivotally openable by means of a hinge module to enable access to the inside of the mobile cooling box.

Mobile cooling boxes are well-known from the state of the art. Usually, a mobile cooling box comprises a thermo-isolated housing for storing the goods to be stored and cooled inside and a lid for allowing access to the inside to put into or remove the goods from the mobile cooling box. It is within the nature of mobile cooling boxes that such boxes are not stationary but are movable by the user. Typically, such mobile cooling boxes are used for any kind of non-stationary use, like for example during outdoor activities, camping, yachting or the like to store and cool goods like food, drinks or even medical products, etc. for a certain period of time.

Known mobile cooling boxes that are openable by pivoting open a lid usually have plastic hinges. Hereby, the plastic of the lid usually forms some kind of pins that engage with respective counterparts like holes at the box main body. In products of higher quality, the pins are sometimes made of metal. Fixation of the pins, especially the of the ones made of metal requires several additional parts like screws, etc. and, thus, requires additional effort and knowledge when assembling the mobile cooling box. Moreover, the pins have to be adjusted correctly during assembling process in order to achieve a correct orientation of the pins with regard to the receiving counterparts so that a smooth and correct function of the lid is guaranteed. Moreover, it is necessary to provide further force guiding and receiving means to enable the pins to withstand the forces occurring during movement of the probably quite heavy lid, i.e. during opening and closing of the lid by the user. This raises the assembling effort and makes assembling process time consuming and, thus, expensive. Moreover, by providing the plenty of parts the overall weight of the mobile cooling box is increased.

Hence, although there are possibilities available in the prior art for a working hinge arrangement for the lid of a mobile cooling box which basically fulfill the requirements for such devices, taking the above drawbacks of known hinge arrangements of mobile cooling boxes into account there is indeed room for improvements in this regard.

The present embodiments, therefore, provide a mobile cooling box with a cost-efficient and reliable and robust hinge construction for the lid of a mobile cooling box.

In order to solve the posed problem, the present embodiments provide a mobile cooling box having a box main body and at least one lid for opening the box and providing access, for example, from above, to the inside of the box. The at least one lid may be pivotally attached to the box main body by at least two hinge modules. Each hinge module has a pin module. The pin module has a hinge pin with a front end, a rear end, a longitudinal axis about which the lid is pivotable and predominantly a smooth outer surface of a cylindrical shape, and a bearing module having a hinge bearing accommodating the hinge pin. The hinge pin laterally extends with its front end into the hinge bearing. Hence, during pivoting the lid with respect to the box main body an axis of the hinge bearing remains co-linear with the longitudinal axis of the hinge pin.

According to the one embodiment, for the mounting of the pin module, the pin module further comprises an engaging portion extending from the rear end of the hinge pin and having a longitudinal axis being co-linear to that of the hinge pin. Thus, the pin module is mountable by the engaging portion.

Thereby, the hinge pin is easily mountable without the need of other components or members like additional screws or bolts. Due to the co-linearity of the axes of the hinge pin and the engaging portion, the position of the pin is ensured.

According to one embodiment of the mobile cooling box, the engaging portion may be a bolt portion, the engaging portion having a male thread. Thereby, mounting is easy and the connection is strong.

According to another embodiment of the mobile cooling box, the pin module further comprises a backing plate between the hinge pin and the engaging portion. The backing plate is positioned in a plane perpendicular to the longitudinal axis of the hinge pin. The backing plate has a pin-side surface and a bolt-side surface. The backing plate has several advantages. It assists at the mounting of the pin module and provides for a stable position thereof ensuring that the pin withstands the forces occurring during movement of the lid while opening or closing the lid.

According to a further embodiment of the mobile cooling box, the backing plate may have a circular shape. Since the complete pin module is screwed or bolted in, the circular shape of the backing plate provides for rotational symmetry. Advantageously, this makes it irrelevant at which rotational position the hinge module is mounted.

According to another embodiment of the mobile cooling box, the pin module may be mounted to the box main body at a vertical surface thereof.

According to a further embodiment of the mobile cooling box, the backing plate abuts with its bolt-side surface against said vertical surface of the box main body. This reliably hinders the pin module from inclining away from the position of the initial longitudinal axis over time during use and thus, contributes to the force resistance of the hinge module.

According to another embodiment of the mobile cooling box, the vertical surface of the box main body has a pin module attachment portion. The pin module attachment portion comprises a bore in which the engaging portion is fastened. Further, the pin module attachment portion comprises a recess for accommodating the backing plate. The recess even more ensures the position of the pin module and hinders inclination of the hinge pin during extensive use. The recess preferably has the same circular shape as the backing plate and, by screwing the pin module in, the backing plate fits with and sinks into the recess.

According to a further embodiment of the mobile cooling box, the recess has a depth corresponding to the thickness of the backing plate. Thus, the transition from said vertical surface of the box main body to the surface of the pin-side surface of the backing plate is essentially flush. This provides for a smooth surface and fewer corners and edges that could be disturbing and contributes to the smooth and robust overall design of the mobile cooling box according to the present embodiments.

According to another embodiment of the mobile cooling box, the hinge pin has a tool engagement portion at its front end for fastening the pin module. This further eases strong fixation of the pin module. The kind of tool engagement portion is not particularly limited. It can be, for example, an outer contour at the hinge pin's front end in the form of a hexagon screw head. However, other forms of tool engagement portions are also possible within the scope of the present embodiments.

According to a further embodiment of the mobile cooling box, the tool engagement portion is a hexagonal socket at the front end face of the hinge pin and the entire hinge pin has a smooth outer surface of a cylindrical shape. Apart from being optically more esthetic, since the entire outer surface of the hinge pin is a smooth cylinder, the hinge construction and the respective pivotal guiding of the lid is more resilient.

According to one embodiment of the mobile cooling box, the entire pin module including the hinge pin, the backing plate and the engaging portion may be formed of metal as one single and integral component. This makes the pin module more robust and contributes to the smooth overall design of the mobile cooling box.

According to another embodiment of the mobile cooling box, the bearing module is present at the lid and the pin module is present at the box main body. Furthermore, the hinge bearing only partly envelops the hinge pin and is open in a direction perpendicular to the longitudinal axis of the hinge pin. Thus, the bearing module allows the hinge pin to be released from the hinge bearing, thereby enabling the lid to be removed completely from the box main body. Removing the lid is of advantage in a number of situations, for example, for cleaning purposes. With one side open of the otherwise pin-surrounding or pin-enveloping hinge bearing, the lid can simply be pulled away from the pivot axis, without the need of any further actions, possibly with only one hand.

According to another embodiment of the mobile cooling box, the bearing module may be configured so that the lid cannot be removed from the box main body when the mobile cooling box is closed. Thus, removing the lid is only possible when the box is open which prevents unintentional lid removal and warming of the inside of the mobile cooling box.

According to a further embodiment of the mobile cooling box, the bearing module may further comprise a spring element configured to hold the hinge pin in place and to provide a predefined and limited resistance when removing the lid from the box main body. Thus, a slight additional force has to be exerted for removing the lid against said resistance. This further prevents the lid from unintentionally falling off the box main body, when the box is open.

According to another embodiment of the mobile cooling box, the bearing module further comprises an abutting portion. The abutting portion, when the lid is pivoted open for a predetermined angle of more than 90°, abuts against a region of the box main body, thereby enabling the lid to rest in the open position. Thus, the lid can stand in a more or less upright position without being held by the user, who, thus, has his or her hands free for loading or unloading the mobile cooling box. Generally, in this embodiment the bearing module with its abutting portion is configured so that the lid can stay in an open position with an angular deflection from the closed position in the range of 91° to 180°, more specifically 91° to 150° and even more specifically 91° to 120°.

In the following, embodiments of the mobile cooling box are described in more detail with reference to the accompanying drawings, wherein FIG. 1 shows a front perspective view of a mobile cooling box according to present embodiments;

Figure 1:
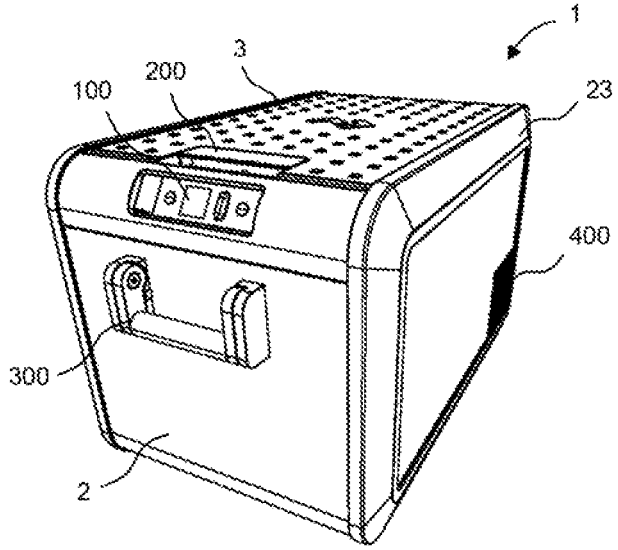

The illustrated mobile cooling boxes 1 in FIGS. 1 to 7 are generally rectangular in shape. Basically, the mobile cooling boxes according to some embodiments have a box main body 2 and one or a plurality of lids, for example two lids 3 for opening the box 1 and providing access to the inside of the box 1. In the present case, access to the inside of the box 1 is possible from above, but is not limited thereto. The front edge of the lid 3 can be pivotally opened. The rear edge is hinged to the box main body 2. At its front and rear edges, the mobile cooling box 1 is rounded, while the side edges are covered and protected by a fender frame 23 that forms part of the box main body 2. The height of the fender frame 23 is equal to the level of the lid 3 when the mobile cooling box 1 is closed. Thus, the lid 3 when being closed sort of sinks or recesses between the two opposite fender frames 23 thus offering a smooth, uniform and robust look of the mobile cooling box.

In this context and within the framework of the present embodiments, but without limitation, all directional terms, like front, rear, back, upper, lower, above, sink, as well as broadness and depth refer to the mobile cooling box 1 standing on the ground as usually intended and from a perspective facing the side of the mobile cooling box 1 were the edge of the lid is pivotable to the above while opening, unless explicitly stated otherwise.

Figure 2:
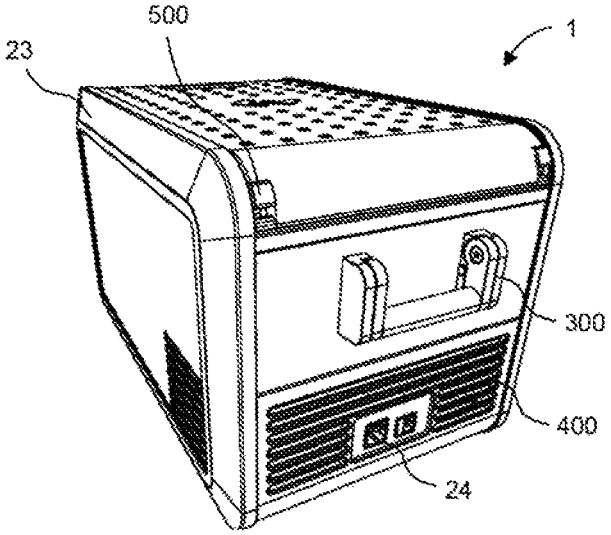
FIG. 2 shows a back-perspective view of the mobile cooling box of FIG. 1.
Figure 3:
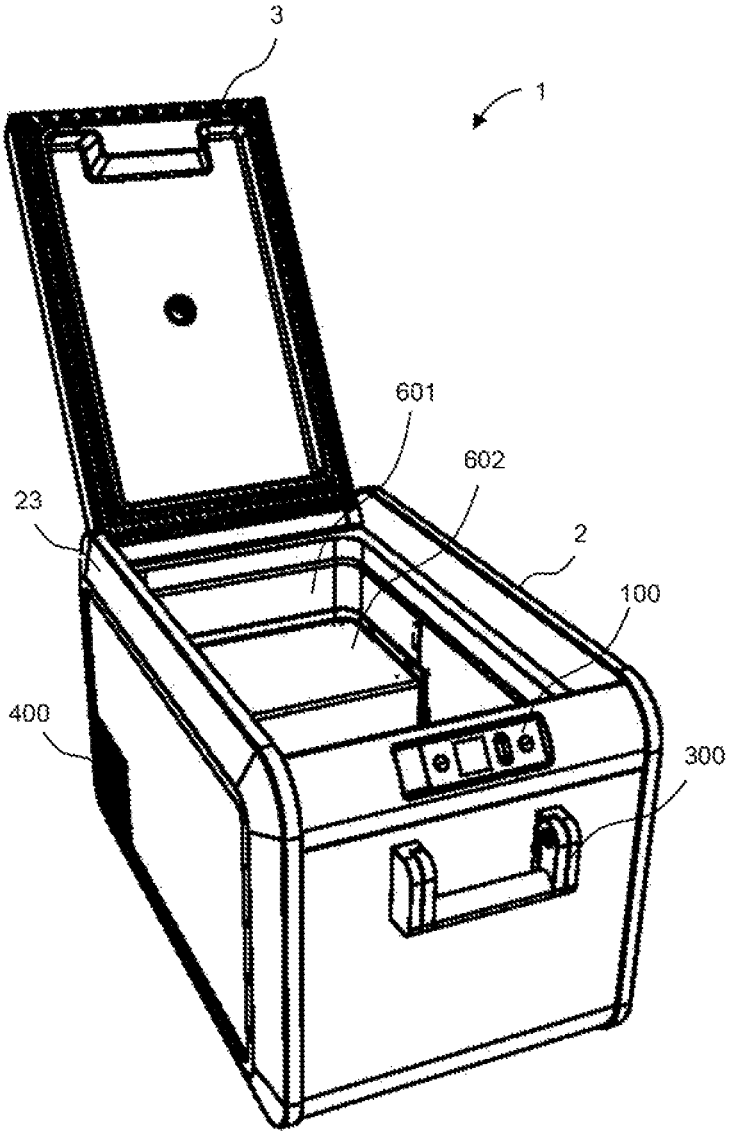
FIG. 3 shows the open mobile cooling box of FIG. 1.
Figure 4:
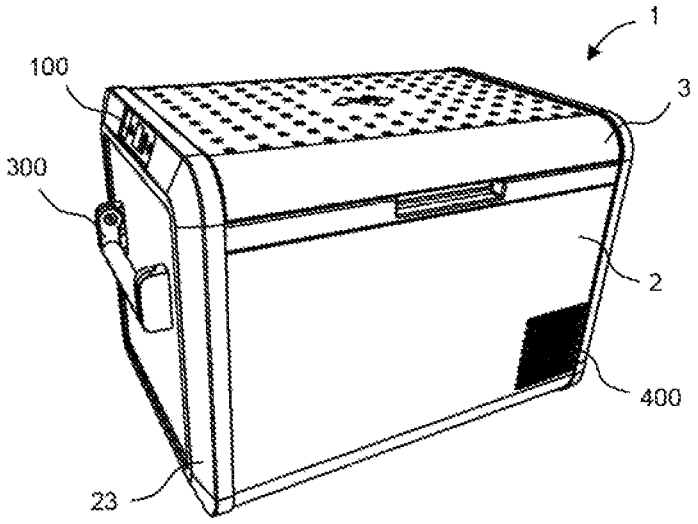
FIG. 4 shows a front perspective view of another mobile cooling box according to present embodiments.
Figure 5:
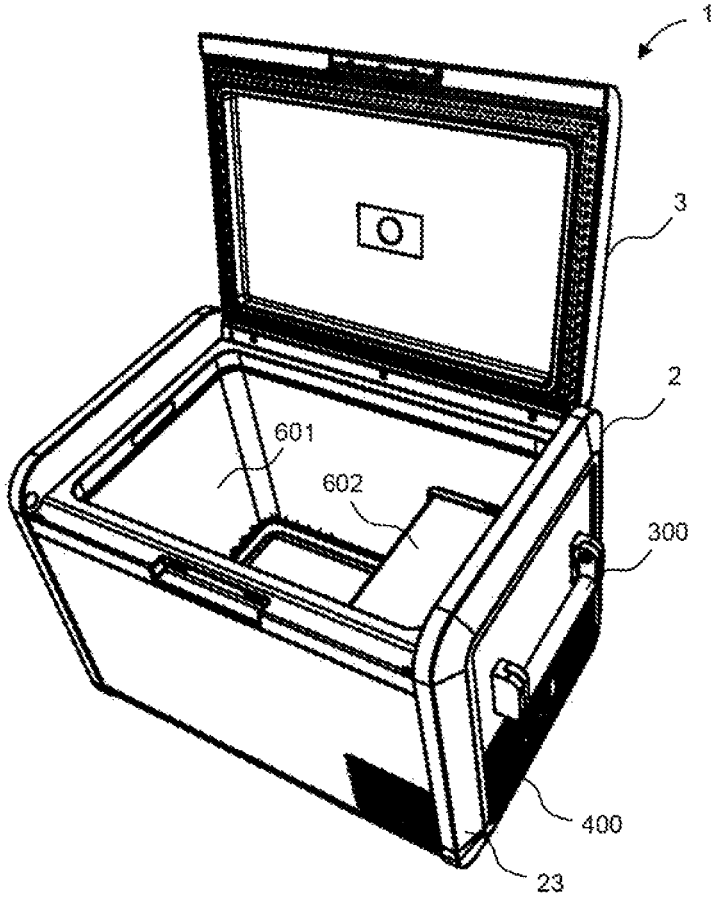
FIG. 5 shows the open mobile cooling box of FIG. 4.
Figure 6:
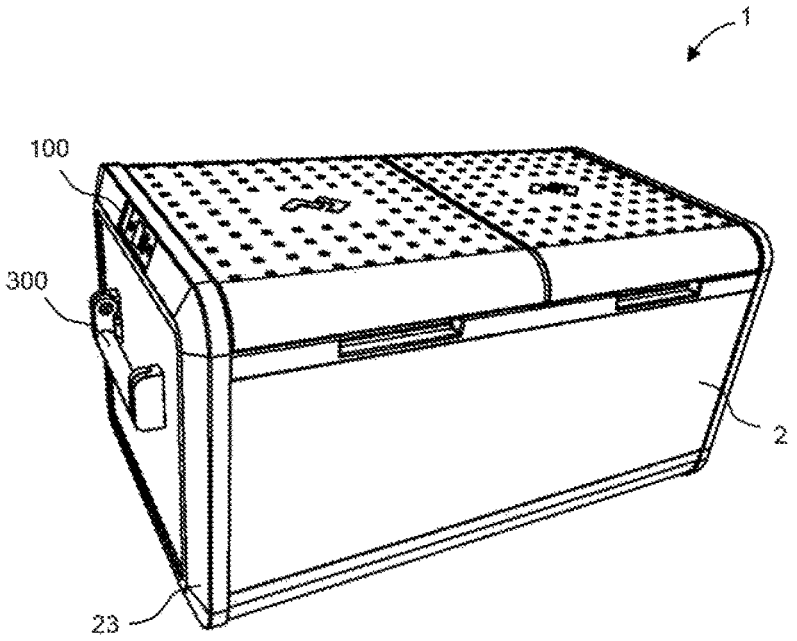
FIG. 6 shows a front perspective view of another mobile cooling box according to present embodiments.
Figure 7:
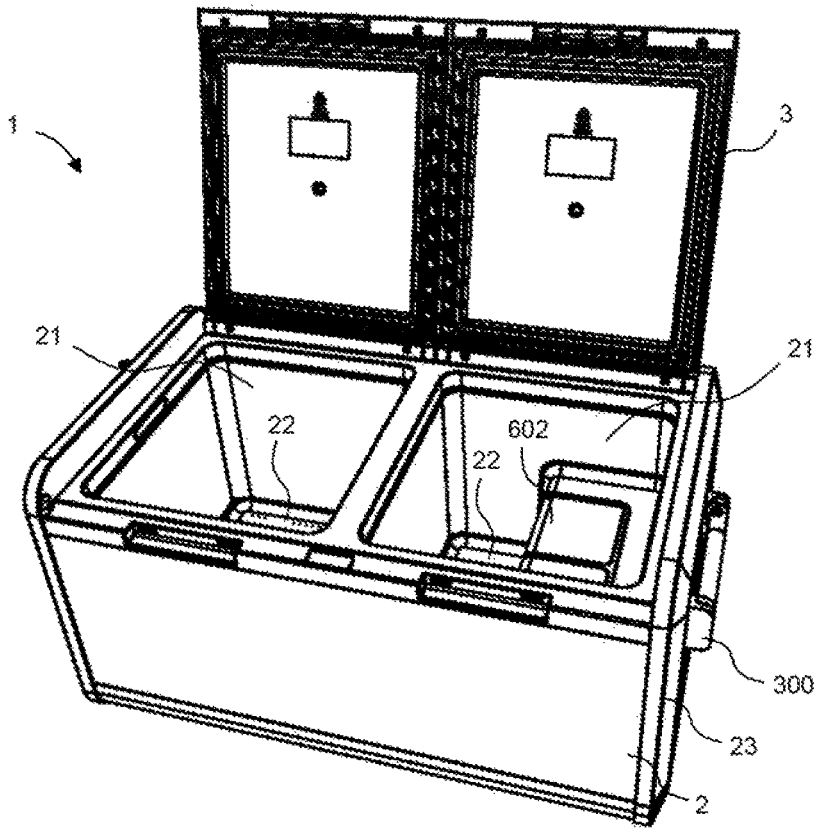
FIG. 7 shows the open mobile cooling box of FIG. 6.

Each illustrated mobile cooling box 1 is of different depth and width. The lid 3 or the lids 3 are to be opened from a side where the fender frame 23 is not located. This is in case of the mobile cooling box 1 of rather small size, as illustrated in FIGS. 1 to 3, the shorter side of the mobile cooling box 1. In case of the two mobile cooling boxes 1 of rather large size, as illustrated in FIGS. 4 and 5 and FIGS. 6 and 7, it is the longer side of the mobile cooling box 1, respectively.

The mobile cooling box 1 has an electrically driven cooling unit and comprises an internal battery (not shown). The mobile cooling box 1 can be used in plugged-in mode or in battery mode. The mobile cooling box 1, therefore, has the required sockets 24 located at one of its sides.

In the following, different aspects and features of the mobile cooling box are described. As will become apparent, many of the following aspects relate to readily mountable modules for various functions which can be mounted without limitation to the mobile cooling box 1 regardless of the size thereof.

Figure 8:
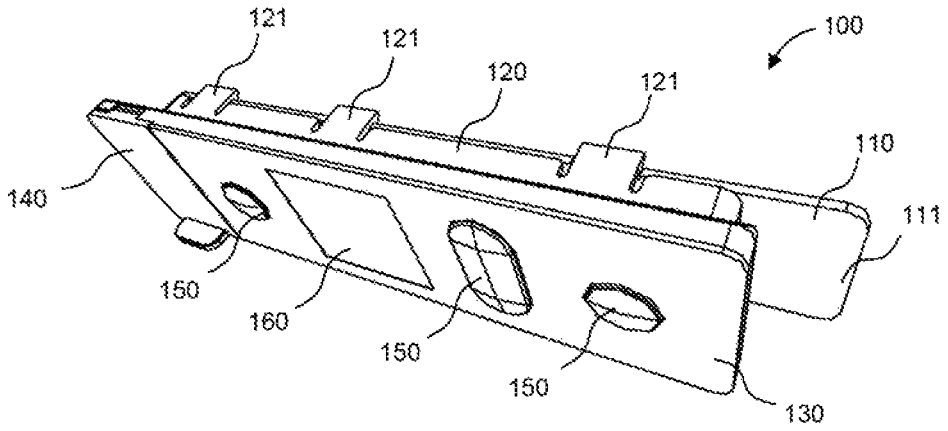
FIG. 8 shows an isolated perspective view of a user interface module.
Figure 9:
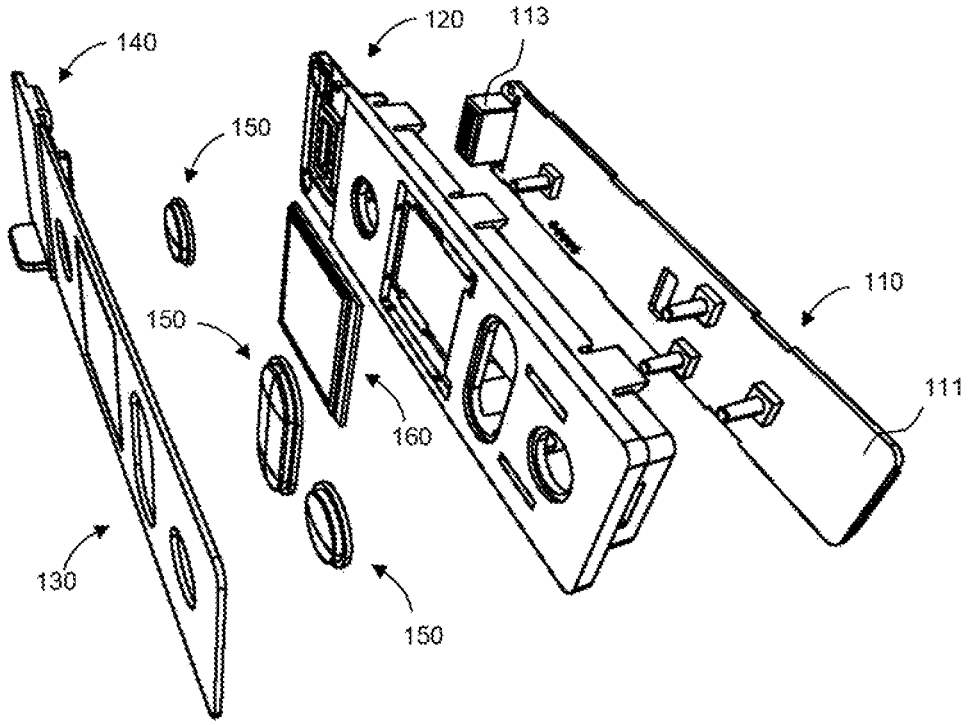
FIG. 9 shows an exploded view of the component of FIG. 8.
Figure 10:
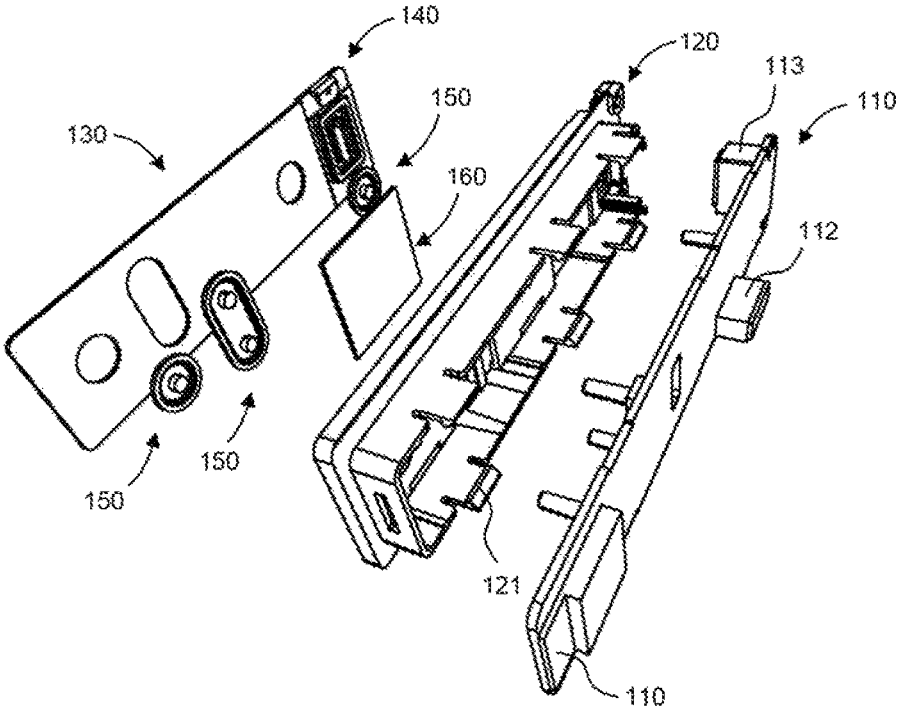
FIG. 10 shows another exploded view of the component of FIG. 8.

The FIGS. 8 to 10 show a user interface. With such a user interface it is possible for the user to sort of communicate with the mobile cooling box 1, that is, retrieving information from the mobile cooling box 1 and entering controls into the mobile cooling box 1. The mobile cooling box 1 is equipped with the user interface module 100 for operation and control by the user. The user interface module 100 is mounted at the mobile cooling box 1 in a way that a part of it is engaged with a designated opening at the mobile cooling box 1 on one side of the user interface module 100 and fixed with additional fixation structure at the other side of the user interface module 100. For example, as illustrated, screws 170 are used for fixing the module 100 at the left side, however other structures may be utilized. On the right side, no screw is necessary. At this side the module 100 is engaged with the designated opening at the mobile cooling box.

As shown in FIGS. 9 and 10, the user interface module 100 is an assembly of components, namely a circuit board 110, a housing 120 and a front cover 130. The assembly is mounted in a recessed part of the mobile cooling box 1 so that essentially only the front cover 130 is directly visible for the user.

The circuit board 110 forms a latch 111 extending away from the right side of the assembly with respect to the housing 120 and the front cover 130. The latch 111 is engaged with the designated opening at the mobile cooling box 1. The circuit board 110 is essentially longer in size than the housing 120 at the right side. The circuit board 110 extends over the edge of the housing 120 and the front cover 130. In the illustrated embodiment, the circuit board 110 extends over the edge of the housing 120 and the front cover 130 for about 1 cm, but also other dimensions are possible. At the backside of the circuit board 110 the part forming the latch 111 is further strengthened by additional material provided in this area.

As shown in FIG. 10, the circuit board 110 has a connector 112. The connector 112 is located at the backside of the circuit board 110. The user interface module 100 is electronically connected with the mobile cooling box 1 by using the connector 112. A respective plug (not shown) is provided in the inside of the box main body 2 of the mobile cooling box 1 and can be reached from the opening in which the user interface module 100 is hooked.

The user interface module 100 further has a USB port 113. In the illustrated embodiment a single USB port 113 is provided. However, there can be also a plurality of USB ports provided, for example depending on the size of the mobile cooling box. The USB port 113 is present at the circuit board 110. Moreover, two through holes for a screw connection are provided. By using the USB port 113 the user can recharge external devices like batteries, lamps, smartphones, etc. Moreover, the USB port 113 provides access to the internal control of the mobile cooling box 1 and, depending on the settings and version, enables download of internal data and/or programming of functions of the mobile cooling box 1.

The housing 120 is clamped onto or over the circuit board 110 by respective clip-in elements 121. In the shown example, three clip-in elements 121 on each of the upper and the lower side of the housing 120 are sufficient to achieve a stable and robust fixation of the housing 120. The housing 120 is formed of an injection molded plastic component. The housing provides co-injected regions of plastic that is softer than at other regions of the housing 120.

At the housing 120, the area of the USB port 113 is left open to allow access to the USB port 113. A rubber cap 140 is provided for covering the USB port 113 when not in use. In the present embodiment, the rubber cap 140 is swingably attached to the housing 120 to avoid losing the rubber cap 140. By removing the rubber cap 113 from the housing 120 access to the USB port 113 becomes possible. Here, the size and design of the rubber cap 140 ensures coverage of the through holes 121 provided for the screw connection at the same time.

The user interface module 100 further has a display 160, the display 160 is arranged behind the front cover 130 and the front cover 130 of the user interface module 100 is transparent at least in the area of the display 160.

The user interface module 100 further has three operation devices, here in the form of buttons 150 extending from the user interface module 100. One of the buttons 150 is located at the right side of the display 160 and provides an up-and-down selection button 150 for navigating through the menu of the control menu of the implemented software. In the illustrated embodiment, two further buttons 150, here designed in form of single round buttons, are provided at both sides next to the display 160, or, respectively, the afore-mentioned button 150. The buttons 150 are made of rubber, or covered by rubber, in order to provide good haptics and provide a stable and robust design.

The front cover 130 user interface module 100 is of a scratch resistant material or has a scratch resistant coating.

The user interface module 100 is capable of wireless communication with an external electronic device, for example by Bluetooth technology, WLAN or any other suitable technology. The external electronic device can be a remote control, a smartphone or the like. Hence, the user interface 100 and thus the mobile cooling box is remote controllable with the external electronic device. In case of using a smartphone, a respective app is available and to be used on the smartphone.

The user interface module 100 provides to the user functions and controls like ON/OFF-switching the cooling, temperature control including setting, if desired in a time-shift manner, displaying current temperature, temperature history graphs, temperature type setting (° C./° F.), alarm setting, energy saving mode, displaying battery status, including voltage level and/or battery remaining time, power consumption history graphs, lid 3 open indication, wireless communication ON/OFF and setting display brightness. The below list shall not be construed as conclusive. Further functions are, thus, also possible.

Figure 11:
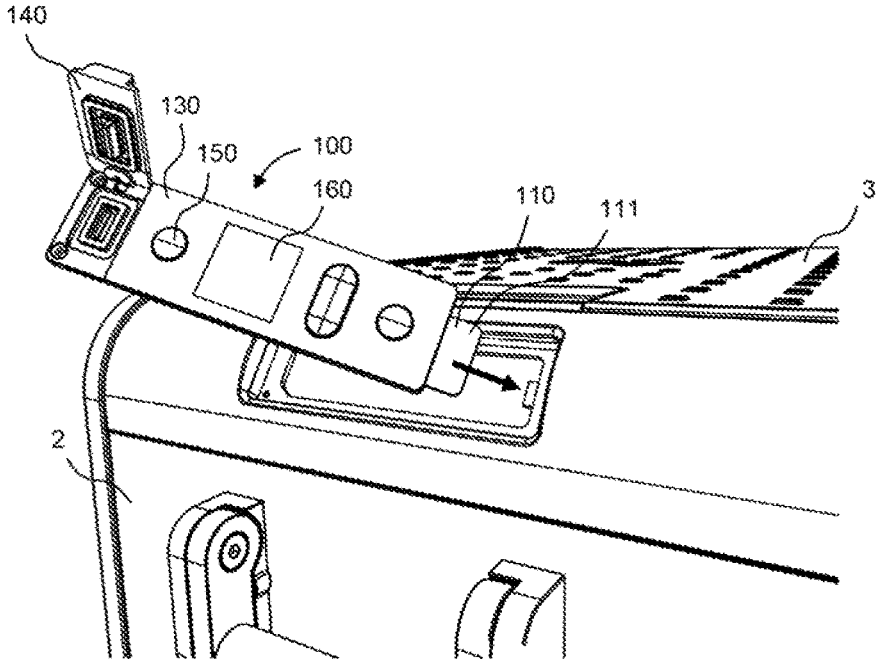
FIGS. 11 to 13 illustrate a sequence of a mounting procedure.
Figure 12:
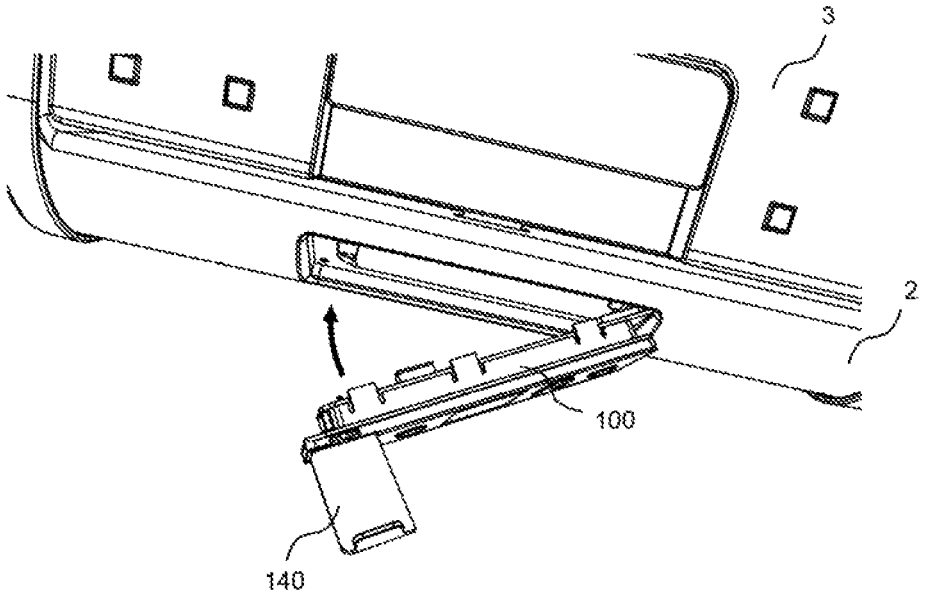
Figure 13:
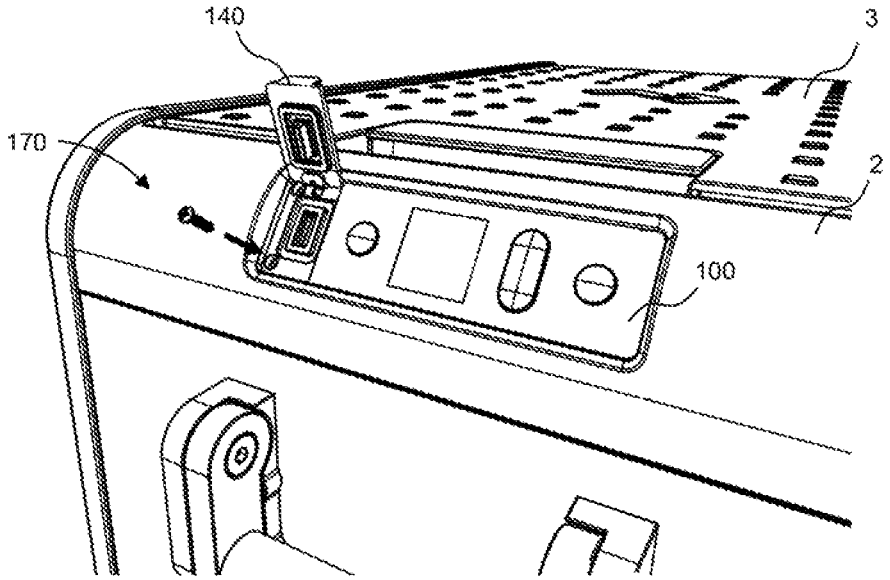
Figure 14:
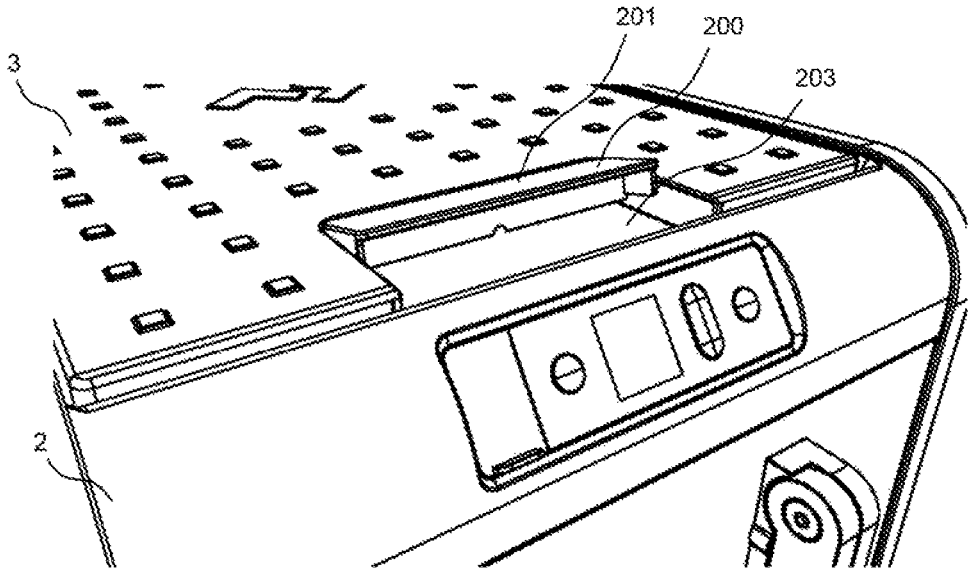
FIG. 14 shows a section of the mobile cooling box of FIG. 1 with actuated latch handle.
Figure 15:
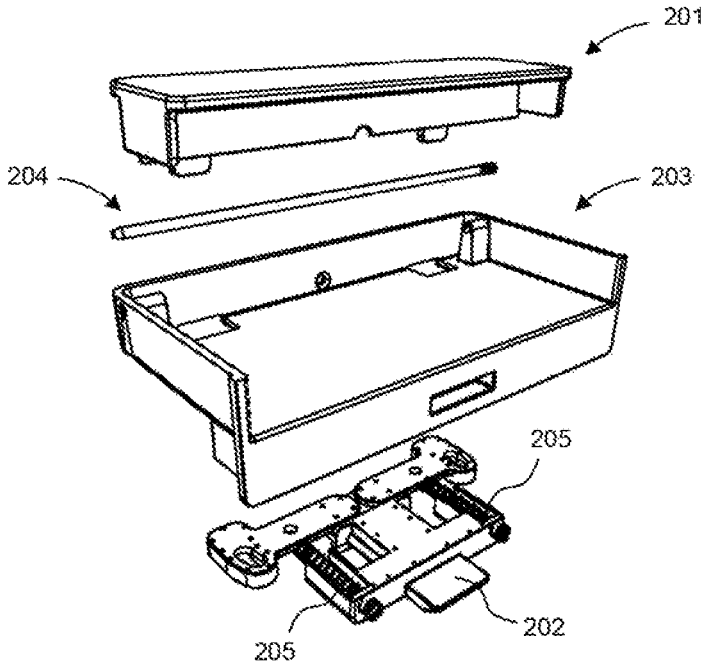
FIG. 15 shows an exploded view of the latch handle of FIG. 14.
Figure 16:
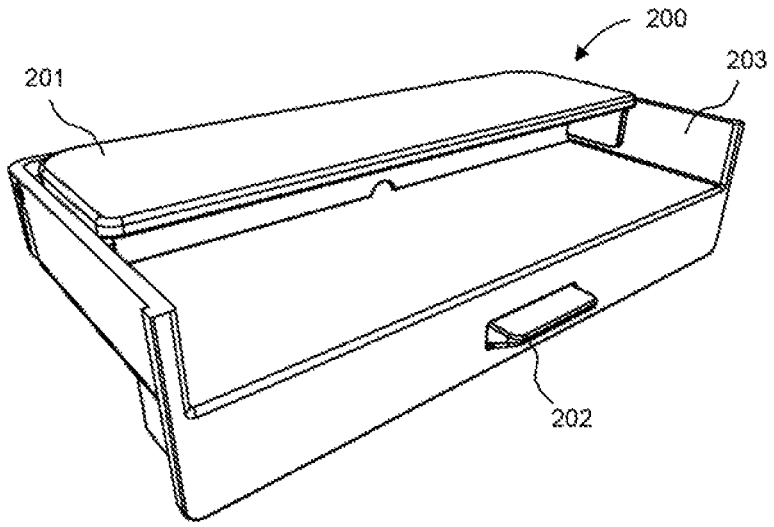
FIG. 16 shows an isolated perspective view of the latch handle of FIG. 14.

For mounting the user interface module 100, the part on the right side of the user interface module 100 that is supposed to be engaged with the designated opening at the mobile cooling box 1 is laterally slid into the designated opening. This step is illustrated in FIG. 11. In FIG. 11 the rubber cap 140 is shown in its open position. However, the rubber cap 140 itself is not involved in the inserting and assembling process of the user interface module 100. After being inserted with the latch 111, the left side of the user interface module 100 is rotated in place as shown in FIG. 12 and, in the next step, the user interface module 100 is fixed with two screws to complete the mounting process.

The mobile cooling box 1 according to some embodiments and as described before has at least one lid 3. By using the lid 3 the mobile cooling box 1 can be opened from one side-edge of the lid 3. Thereby, access is provided to the inside of the box 1. At the opposite side-edge of the lid 3, the lid 3 is hinged to the box main body 2. By this hinge connection the lid 3 can be pivoted upwards.

As shown in FIGS. 14 to 17, the mobile cooling box 11 is equipped with a latch handle module 200. The latch handle module 200 allows manually locking and unlocking of the lid 3 and, thus, opening and closing the mobile cooling box 1 by the lid 3. The latch handle module 200 is integrated in the lid 3 and located at the front side edge of the lid 3 of the illustrated embodiment of the mobile cooling box 1.

The latch handle module 200 is an assembly of components including an actuating element 201, a locking element 202 and a casing 203. The actuating element 201 is manually operable by the user. The locking element 202 is engageable with a corresponding counterpart at the box main body 2. By engaging the corresponding counterpart at the box main body 2 the lid 3 is locked from being opened.

Figure 17:
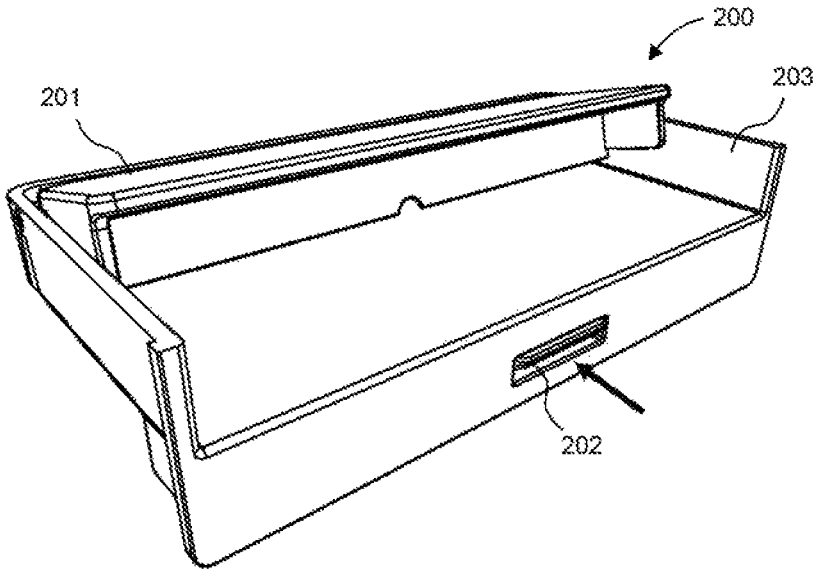
FIG. 17 illustrates the working principle of the latch handle of FIG. 14.

The latch handle module 200 provides a mechanism for locking and unlocking the lid 3. According to the latch handle module 200 the actuating element 201 and the locking element 202 are mechanically connected to each other. As illustrated in FIG. 17, by operating the actuating element 201, the locking element 202 disengages with its corresponding counterpart at the box main body 2 and allows up-folding the lid 3. In this embodiment, the locking element 202 is designed as a snap-in latch. The snap-in latch, in a closed state, extends into the corresponding counterpart being a recess in the box main body 2. Furthermore, the actuating element 201 has a surface which can be pushed by the fingers of the user's hand. In the illustrated embodiment the actuating element 201 has a width of about 10 cm. However, according to the overall size the width of the actuating element 201 can have also a different size. For opening the lid 3, the actuating element 201 is pivoted about an axis of rotation with a pivoting direction that is the same as that of the lid 3 when being opened. Therefore, there are no opposing movements for the user's hand, which has been found to be comfortable for the user.

As regards the working principle of the latch handle module 200, the latch handle module 200 further comprises a shaft 204. The shaft 204 has a longitudinal axis being co-linear with the axis of rotation of the actuating element 201. The actuating element 201 is connected to and pivotable about the shaft 204. The shaft 204 is of a rigid metal material and extends essentially over the entire width of the latch handle module 200. The latch handle module 200 further has two springs 205 by means of which the mechanism provided by the latch handle module 200 is spring loaded. The mechanism provided by the latch handle module 200 is spring loaded for providing a restoring force that ensures that the actuating element 201 and the locking element 202 return to their respective initial positions after an operation of the actuating element 201 by the user.

Figure 18:
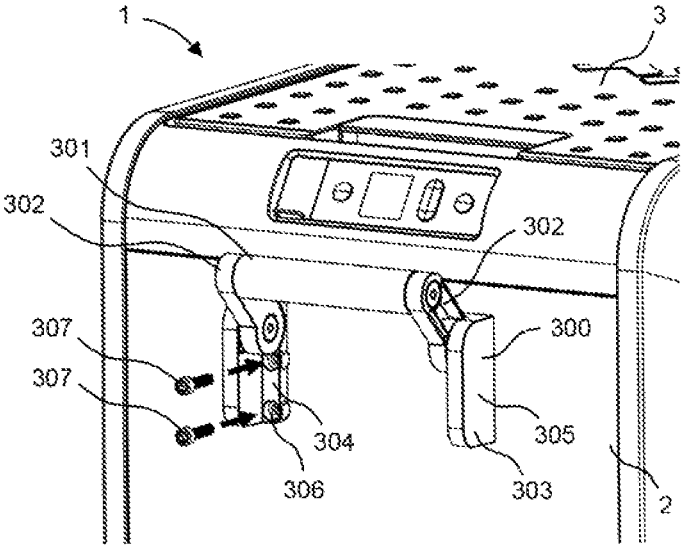
FIG. 18 illustrates the mounting procedure of a handle module.
Figure 19:
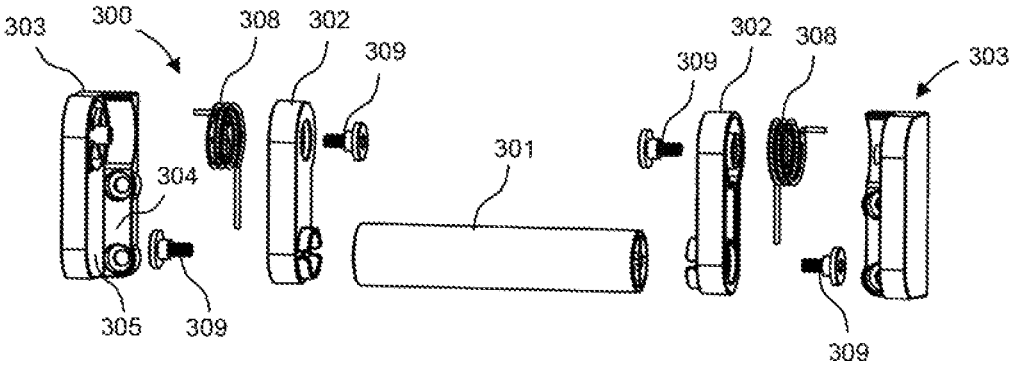
FIG. 19 shows an exploded view of the handle module of FIG. 18.

As shown in FIGS. 18 and 19, the mobile cooling box 1 is equipped with two handle modules 300. The two handle modules 300 are located at an outer side surface of the box main body 2. One handle module 300 has a handlebar 301. The handlebar 301 is intended to be grasped by the hand of the user and has a longitudinal axis as well as two ends, two hangers 302 and two brackets 303. The handlebar 301 is attached at its two ends to the two hangers 302. The hangers 302 are rotatably mounted at the two brackets 303. The two brackets are fixed to the outer side surface of the box main body 2.

The handle module 300 is designed in a way that the handle 301 hangs downwards in an unactuated state and can be swung out and upwards for carrying the mobile cooling box 1.

Each of the brackets 303 comprises a mounting area, or mount, 304 and a shielding area, or shield, 305. The mounting area 304 faces the outer side surface of the box main body 2 to which the bracket 303 is fixed. The shielding area 305 hides the hangers 302 and the handlebar 301 in an unactuated state of the handle module 300 and in a lateral perspective along the longitudinal axis of the handlebar 301.

The handle module 300 is designed so that, in an unactuated state of the handle module 300 and in a lateral perspective along the longitudinal axis of the handlebar 301, at least a section of the outer contour of the shielding area 305 is flush with the handlebar 301 and with the hangers 302. Thus, when the mobile cooling box 1 is not carried, the handlebar 301 with its hangers 302 exactly hides behind the bracket 303 in the respective lateral perspective.

The handlebar 301 and its hangers 302 are spring-loaded. Thus, in an unactuated state, the handlebar 301 and the hangers 302 are forced in a direction to the mobile cooling box 1 and are thus kept hidden in-between the shielding areas 305 of both brackets 303. For this purpose, two springs 308 are arranged within the handle module 300. The springs 308 force the hangers 302 relative to the brackets 303 to abut against the part with the mounting area 304.

The handle module 300 is designed in a way that, in an actuated state, the hangers 302 with the handlebar 301 are swung out and upwards and rest in a position relative to the mobile cooling box 1. Thus, the mobile cooling box 1 can be carried in a comfortable way. The hangers 302 with the handlebar 301 rest in the position by means of a region of the hangers 302 abutting against a region of the brackets 303. Thereby, at the joint between the brackets 303 and the hangers 302, the hangers are rounded in a section around the respective pivot axis. Moreover, a corresponding roundness is present at the brackets 303 to the extent that, when the hangers pivot out, the round part of the brackets 303 that enclose the round part of the hangers abut against the flanks of the hangers 302. Thus, further rotation of the hangers 302 is blocked.

Furthermore, at its mounting area 304 each bracket 303 comprises two through holes 306 for fixing the bracket 303 to the outer side surface of the box main body 2 by means of fixing elements 307. In the illustrated embodiment of the mobile cooling box the fixing elements are designed in the form of screws but are not limited thereto. The through holes 306 and the respective fixing elements 307 are covered by the hanger 302 that is mounted to said bracket 303, in an unactuated state of the handle module 300. Thereby, the hanger 302 abuts against said mounting area 304.

An additional accessory, like for example a bottle opener (not shown) or other equipment or tooling, can be attached at the through holes 306 by respective means, like for example screws.

As mentioned, the mobile cooling box 1 is basically rectangular in shape and has different dimensions in width and depth and height. Further, the two handle modules 300 are located at the respective two shorter outer side surfaces of the mobile cooling box 1 being opposite to each other. Thereby, when carrying the mobile cooling box 1 a tilting of the mobile cooling box 1 can be avoided.

In the present embodiment the handlebar 301 has a circular cross-section. Moreover, the handlebar 301 has a length of at least 10 cm to ease gripping the handlebar by the user's hand. However, other dimensions are also possible. The lower part of the hangers 302 correspond with this rounded contour. Also, the lower part of the brackets 303 partly correspond with this contour. Hence, the components are flush in an unactuated state.

At least the handlebar 301, the hangers 302 and the brackets 303 of the handle module 300 are made of aluminum. At least part of the surface of the aluminum is roughened and has an oxidic protective layer.

Figure 20:
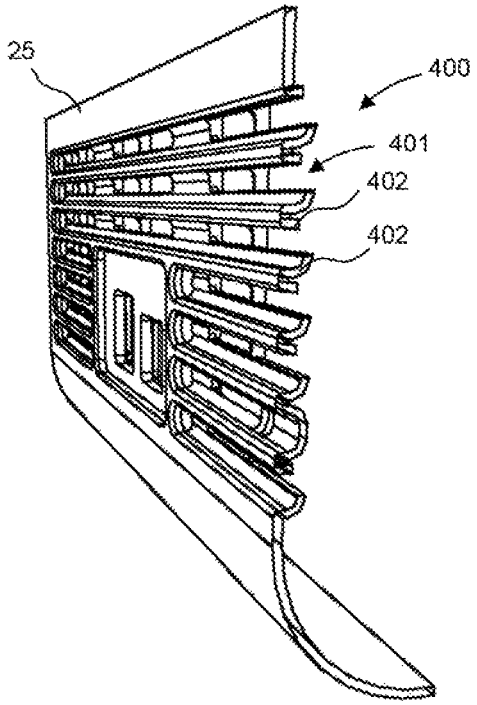
FIGS. 20 and 21 show different perspectives of a cut view of the outer side wall.
Figure 21:
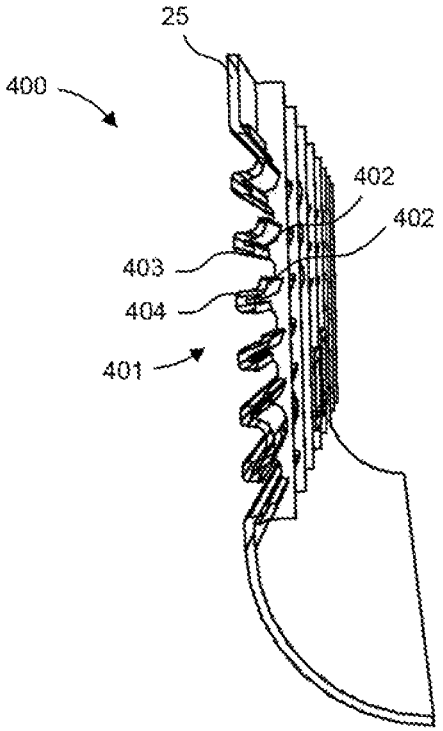
Figure 22:
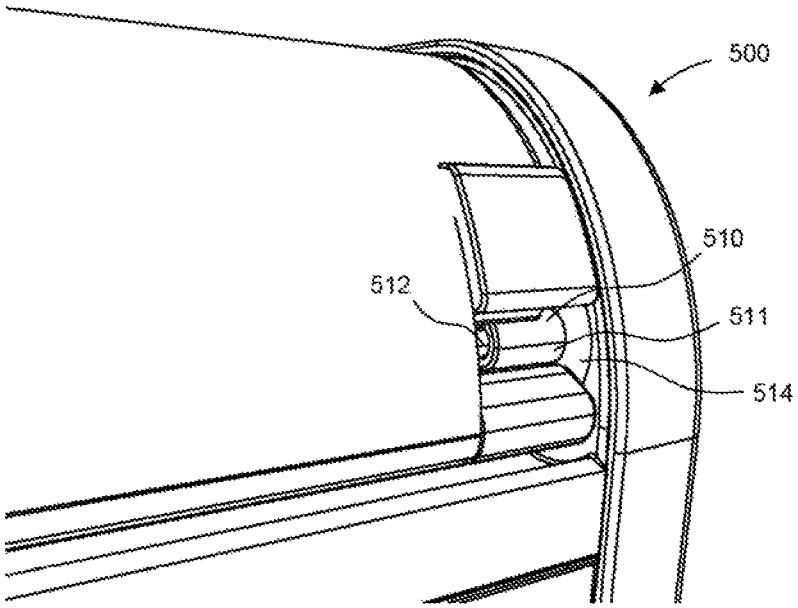
FIG. 22 shows a section of the mobile cooling box of FIG. 1 with a hinge module.
Figure 23:
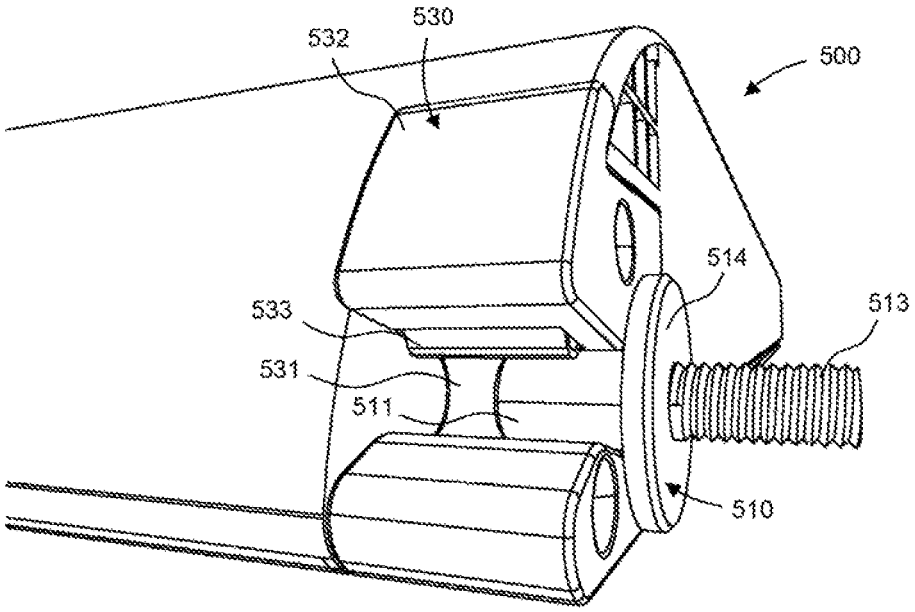
FIG. 23 shows relevant parts of FIG. 22.
Figure 24:
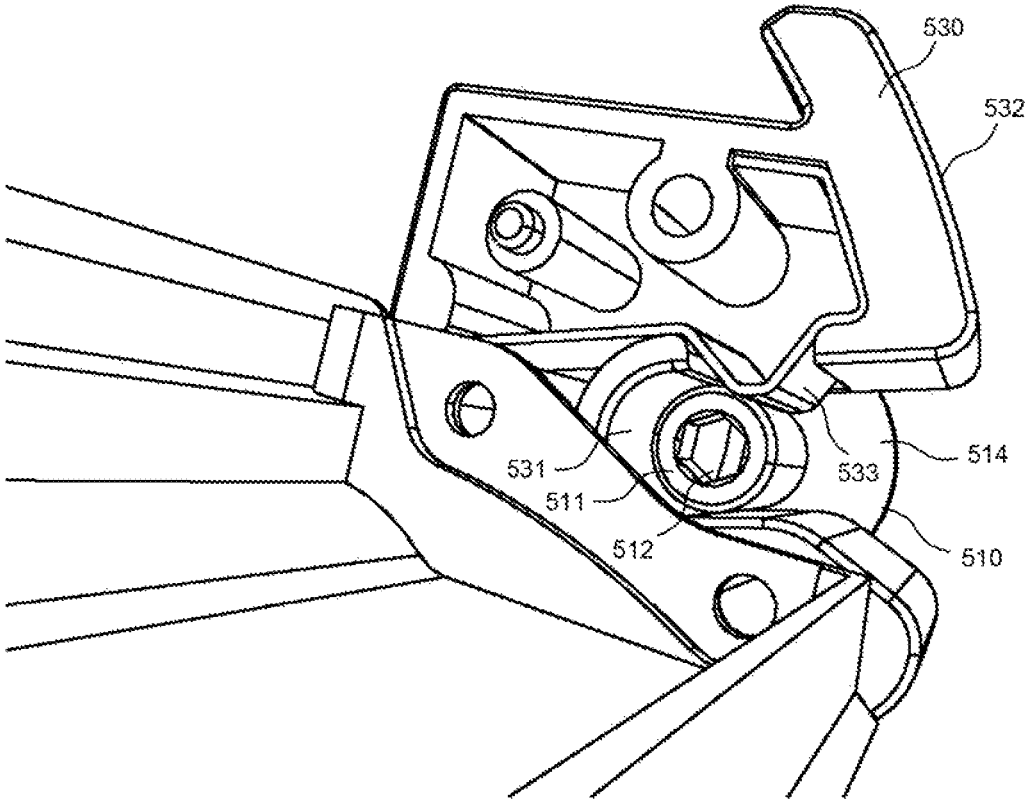
FIG. 24 shows an inside perspective view of the hinge module of FIG. 22.
Figure 25:
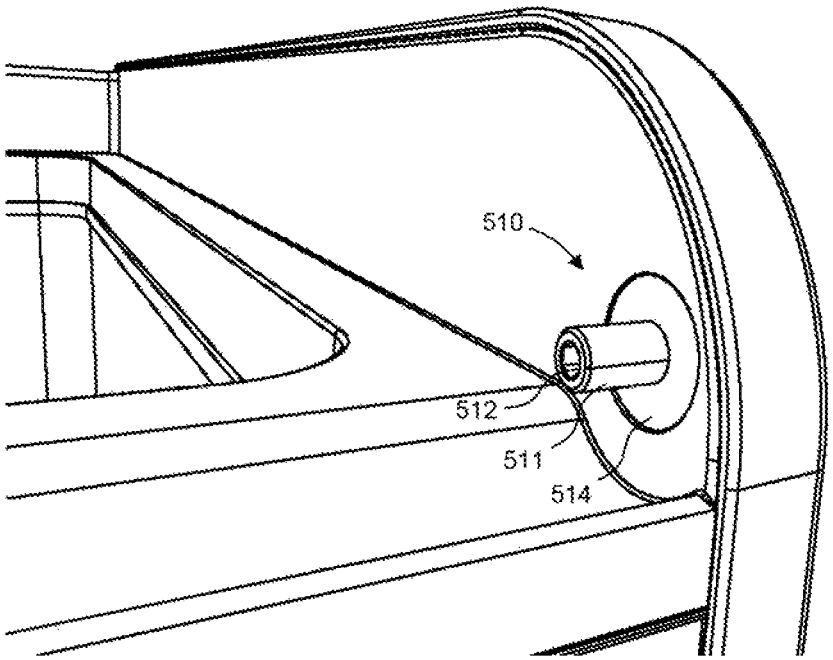
FIG. 25 shows a section of the mobile cooling box of FIG. 1 with removed lid.
Figure 26:
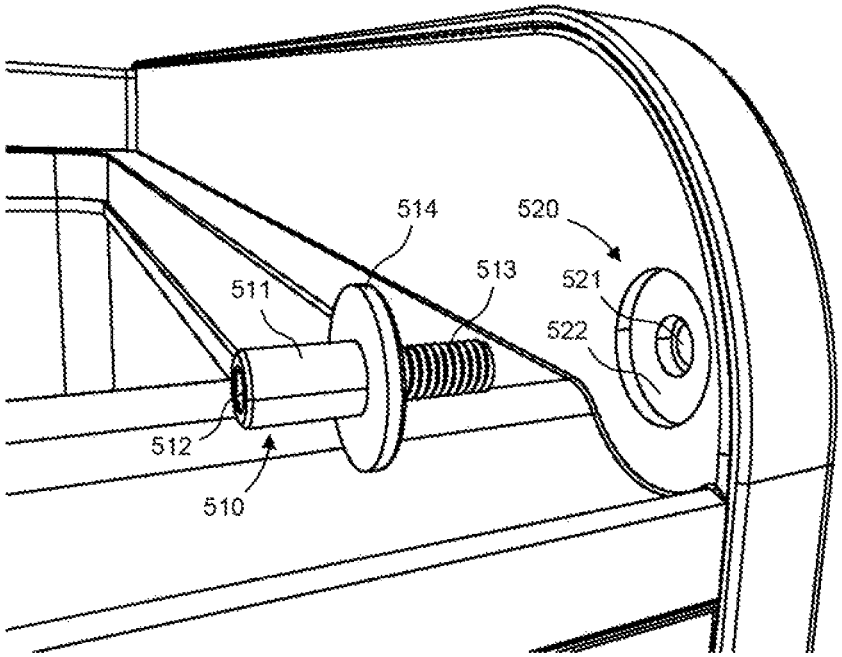
FIG. 26 shows the section of FIG. 25 and illustrates a mounting procedure.

As illustrated in FIGS. 20 and 21, the mobile cooling box 1 is equipped with air vents 400. The air vents 400 are located on at least one side wall of the box main body 2. In the periphery of the air vents 400 cord fixation means are present (not shown). The electrical cord (not shown) provided for connecting the mobile cooling box to electrical power can be, especially in case the cord is not in use, attached to the outside of the mobile cooling box 1 in a known manner. The cord fixation means can for example be formed in the shape of hooks to which the cord can be removably attached. Nearby the air vents 400, as illustrated in FIG. 20, at least one power connector is present to connect the removable power cord (not shown) to the mobile cooling box 1 to supply electrical power to the mobile cooling box 1.

The air vents 400 comprise a plurality of horizontal opening or slots 401 (in the following generally referred to as slots), respectively, allowing air circulation through the respective side wall of the mobile cooling box 1. The slots 401 comprise shielding elements 402 protruding inside the mobile cooling box 1. Each of the shielding elements 402 is designed in such a way that the shielding element at least partly blocks the view into the inside of the mobile cooling box 1 from the outside. In other words, the inside of the mobile cooling box 1 is not visible from the outside due to the design of the shielding elements 402.

One slot 401 has an upper edge 403 and a lower edge 404. Both, the upper edge 403 and the lower edge 404 lie in the plane of the respective side wall. One of the shielding elements 402 extends from the lower edge 404 to the inside of the mobile cooling box 1 and further upwards with respect to said lower edge 404, virtually in the direction of and at least up to the height of the upper edge 402. Thus, the inside of the mobile cooling box 1 is not visible from the outside due to the design of the shielding element 402

Particularly, in a vertical cross section perpendicular to said side wall, the shielding element 402 extends from the lower edge 404 in upward curved form, namely in the form of a segment of a circle.

Furthermore, one of the shielding elements 402 extends from the upper edge 403 to the inside of the mobile cooling box 1.

Particularly, in a vertical cross section perpendicular to said side wall, the shielding element 402 extends from the upper edge 403 to the inside of the mobile cooling box 1 in a straight horizontal direction. This has essentially the function of providing more stability to the side wall and to uniform the upper and lower edges 403 and 404 with regard to the roundness.

The side wall where the vents are present is manufactured together with the shielding elements 402 as a one-piece component which is made of plastic and manufactured by injection molding.

As is shown in FIGS. 22-26, the mobile cooling box 1 has a lid 3. The lid 3 is pivotally attached to the box main body 2 by means of two hinge modules 500. Each hinge module 500 comprises a pin module 510. The pin module 510 has a hinge pin 511 with a front end, a rear end, a longitudinal axis about which the lid 3 is pivotable, and a smooth outer surface having a cylindrical shape.

The hinge module 500 further comprises a bearing module 530. The bearing module 530 has a hinge bearing 531 accommodating the hinge pin 511. The hinge pin 511 laterally extends with its front end into the hinge bearing 531. Thus, during pivoting the lid 3 with respect to the box main body 2 an axis of the hinge bearing 531 remains co-linear with the longitudinal axis of the hinge pin 511.

For the mounting of the pin module 510, the pin module 510 further comprises an engaging portion 513, here in form of a bolt portion 513. The bolt portion 513 has a male thread and extends from the rear end of the hinge pin 511. The bolt portion 513 has a longitudinal axis being co-linear to that of the hinge pin 511.

The pin module 510 further comprises a backing plate 514 between the hinge pin 511 and the bolt portion 513. The backing plate 514 lies in a plane perpendicular to the longitudinal axis of the hinge pin 511 and has a pin-side surface and a bolt-side surface. The backing plate 514 has a circular shape so that it is symmetrical with regard to rotation.

The pin module 510 is mounted to the box main body 2 at a vertical surface thereof which is the inner sider of a part of the box main body 2. The backing plate 514 abuts with its bolt-side surface against said vertical surface of the box main body 2.

Furthermore, the vertical surface of the box main body 2 to which the pin module 510 is attached to has a pin module attachment portion 520. The pin module attachment portion 520 comprises a bore 521 having a female thread, in which the bolt portion 513 is fastened, and a recess 522 for accommodating the backing plate 514. The recess 522 has a depth corresponding to the thickness of the backing plate 514. Hence, the transition from said vertical surface of the box main body 2 to the surface of the pin-side surface of the backing plate 514 is flush. In order to provide for sufficient stability, the thickness of the backing plate 514 is about 2 mm.

Furthermore, the hinge pin 511 has a tool engagement portion 512 at its front end for fastening the pin module 510. The tool engagement portion 512 is a hexagonal socket that is engageable with a hex key at the front end face of the hinge pin 511. Moreover, the entire hinge pin 511 has a smooth outer surface of a cylindrical shape, so that the pivoting movement can be guided over the entire length of the hinge pin 511.

The entire pin module 510 including the hinge pin 511, the backing plate 514 and the bolt portion 513 is formed of metal. Moreover, the entire pin module 510 is formed as one single and integral component. Thus, the pin module 510 is very robust component.

The bearing module 530 is present at the lid 3 and the pin module 510 is present at the box main body 2. The hinge bearing 531 only partly envelops the hinge pin 511 and is open in a direction perpendicular to the longitudinal axis of the hinge pin 511. Thus, the bearing module 530 allows the hinge pin 511 to be released from the hinge bearing 531, thereby enabling the lid 3 to be removed completely from the box main body 2. In particular, when it is pivoted in an open direction for about 60° and more the lid 3 can be removed. Thus, the bearing module 530 is configured so that the lid 3 cannot be removed from the box main body 2 when the mobile cooling box 1 is closed.

The bearing module 530 further comprises a spring element 533. The spring element 533 protrudes out of an upper surface part of the hinge bearing 531. The spring element 533 is configured to hold the hinge pin 511 within the hinge bearing 531 and to provide a certain resistance during removing the lid 3 from the box main body 2.

The bearing module 530 further comprises an abutting portion 532. When the lid 3 is pivoted in the open direction for an angle of about 100° the abutting portion 532 abuts against a region of the box main body 2. Thereby, the lid 3 is enabled to rest in an open position.

Figure 27:
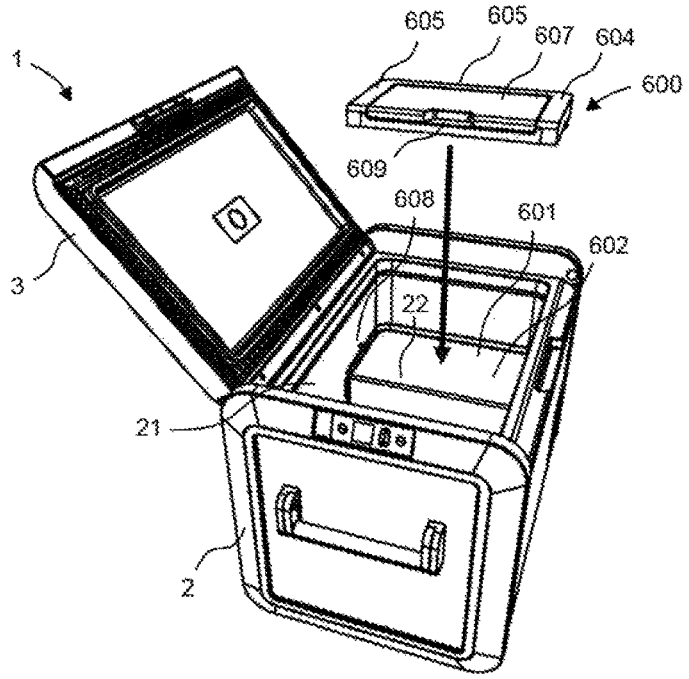
FIG. 27 illustrates the insertion of an ice maker module into the open mobile cooling box of FIG. 4.
Figure 28:
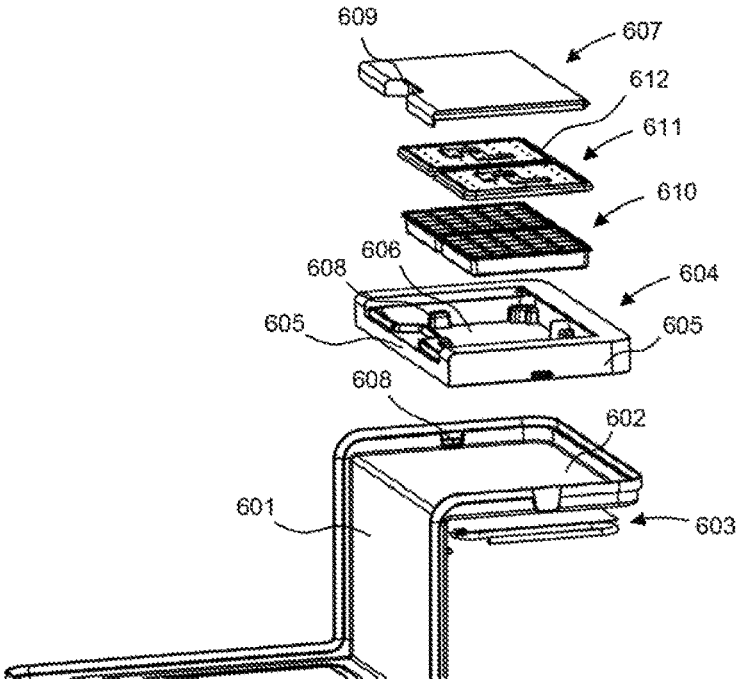
FIGS. 28 and 29 show different perspectives of an exploded view of the ice maker module.
Figure 29:
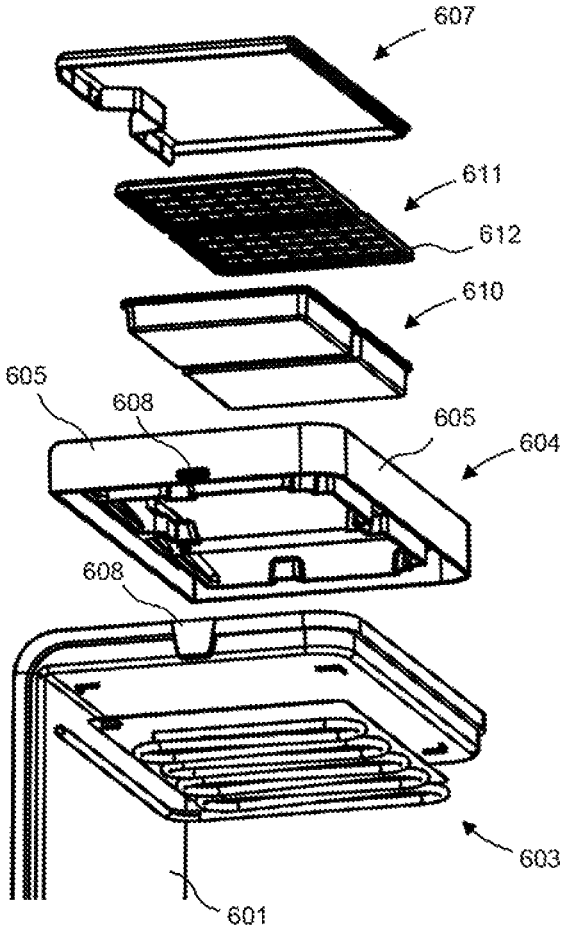

As shown in FIGS. 27 to 29 the mobile cooling box 1 has an inside that is laminated with a lining 601 at the inner side walls 21 and at the floor 22 of the box main body 2.

The mobile cooling box 1 is equipped with an ice maker module 600. The ice maker module 600 has a freezing compartment 606. The ice maker module 600 can be removably placed on a freezing zone 602 on a floor part of the lining 601.

The mobile cooling box 1 further comprises an evaporator 603 arranged underneath the lining 601 at the freezing zone 602, for providing sufficient cooling power for freezing goods.

The ice maker module 600 is an assembly of components, namely a frame 604 and a cover 607. The frame 604 has lateral walls 605 limiting the freezing compartment 606. The cover 607 is attached to the upper side of the frame 604 for opening and closing the ice maker module 600 and providing access from above to the freezing compartment 606. The freezing compartment 606 is limited at its ground by the lining 601 at the freezing zone 602. Thus, the goods to freeze are placed directly on the floor part of the freezing zone 602 for efficient freezing.

The freezing zone 602 is rectangular and is located in a niche limited by the lining 601 of three of the inner side walls 21. The ice maker module 600 fits in the niche.

At least one pair of corresponding attachment means 608 configured to releasably engage with each other is present at the lining 601 of the inner side walls 21 adjacent to the freezing zone 602 and at the ice maker module 600, respectively. By the at least one pair of corresponding attachment means 608 the position of the ice maker module 600 is secured. The pair of attachment means 608 provides for a form-locked connection being a snap-in connection. The snap-in connection consists of hook and a corresponding recess. The hook is a projecting element that is configured to snap in the recess. The hook is located at the ice maker module 600 and the corresponding recess is located at the lining 601 of the respective inner side wall 21. The hook is located at the frame 604 of the ice maker module 600.

The hook and the recess of one pair of corresponding attachment means 608 are formed as integral parts of the lining 601 and the ice maker module 600, respectively.

Furthermore, the cover 607 is hinged to the frame 604. Thus, the cover 607 is swingably openable to the above and can be opened about an angle of about 100°. The cover 607 has a grip portion 609 by means of which the cover 607 can be opened and closed by the hand of the user.

The ice maker module 600 further comprises two ice trays 610. The ice trays 601 fit into the freezing compartment 606. Each of the ice trays 601 is equipped with a cap 611. Each ice tray 610 has a plurality of recesses for forming ice cubes. The cap 611 has small holes 612 in form of bores with a rather small diameter. By these holes air exchange is enabled between inside and outside of the ice tray, but predominantly preventing water from leaking out.

The opening of the tiny holes has a cross section of about 0.20 mm. Above each recess, one of the tiny holes is arranged.

Figure 30:
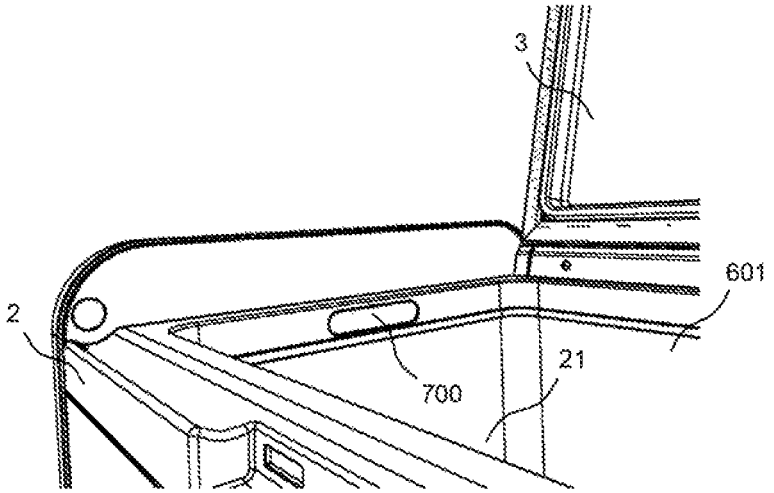
FIG. 30 shows a section of the open mobile cooling box of FIG. 4 with a lamp system.

As shown in FIG. 30 the mobile cooling box 1 comprises a lamp module 700. By the lamp module 700 light can be provided in the inside of the box main body 2. To turn on the lamp module 700 it does not have any mechanical switches as in usual refrigerators. In the present embodiment of the lamp module 700 can be switched ON or OFF by means of a reed sensor (not shown). The front cover of the lamp module 700 is perfectly flush with the surface at which the lamp module 700 is arranged.

The front cover is mounted to the inner lining in a waterproof manner. Specifically, the front cover of the lamp module 700 is clipped in a corresponding recessed part of the inner lining and is equipped with sealed portions.

Furthermore, the front cover of the lamp module 700 is transparent and provides a diffuse light. The light is emitted from diodes inside the lamp module 700 and both, the light-emitting diodes and the reed sensor are mounted on a circuit board of the lamp module 700.

For switching the light ON and OFF, a magnet is incorporated in the part of the lid 3 that functionally corresponds with the reed sensor. In the closed state of the lid 3, the magnet is located in the vicinity of the light module 700 so that the light module is switch OFF. While opening or in the opened state the distance of the magnet, thus, is increased and the light module is switch ON by the reed sensor.

REFERENCE SIGNS

1 Mobile cooling box
2 Box main body
3 Lid
21 Inner side wall of box main body
22 Floor of box main body
23 Fender frame
24 Socket
25 Outer side wall of box main body
100 User interface
110 Circuit board
111 Latch
112 Connector
113 USB port
120 Housing
121 Clip-in element
130 Front cover
140 Rubber cap
150 Operation device/button
160 Display
170 Screw
200 Latch handle module
201 Actuating element
202 Locking element
203 Casing
204 Shaft
205 Spring at the latch handle
300 Handle module
301 Handlebar
302 Hanger
303 Bracket
304 Mounting area

305 Shielding area
306 Through hole
307 Fixing elements
308 Springs at the handle
309 Screws of the handle
400 Air vents
401 Opening/slot
402 Shielding element
403 Upper edge
404 Lower edge
500 Hinge module
510 Pin module
511 Hinge pin
512 Tool engagement portion
513 Engaging portion/bolt portion
514 Backing plate
520 Pin module attachment portion
521 Bore
522 Recess
530 Bearing module
531 Hinge bearing
532 Abutting portion
533 Spring element
600 Ice maker module
601 Lining
602 Freezing zone
603 Evaporator for the freezing zone
604 Frame
605 Walls of frame
606 Freezing compartment
607 Cover of ice maker module
608 Attachment means
609 grip portion
610 Ice tray
611 Ice tray cap
612 Tiny holes
700 Lamp module

The invention claimed is:

1. A mobile cooling box comprising:

a box main body and at least one lid for opening the box and providing access to the inside of the box, the at least one lid being pivotally attached to the box main body by at least two hinge modules, wherein each of said at least two hinge modules are disposed at ends of said at least one lid, wherein each hinge module of said at least two hinge modules comprises a pin module having a hinge pin with a front end, a rear end, a longitudinal axis about which the at least one lid is pivotable and predominantly a smooth outer surface of a cylindrical shape, wherein each said hinge module further comprises a bearing module having a hinge bearing accommodating the hinge pin, wherein the hinge pin laterally extends with its front end into the hinge bearing, so that during pivoting the at least one lid with respect to the box main body an axis of the hinge bearing remains co-linear with the longitudinal axis of the hinge pin, and wherein the pin module further comprises an engaging portion extending from the rear end of the hinge pin and having a longitudinal axis being co-linear to that of the hinge pin so that the pin module is mountable by the engaging portion.

2. The mobile cooling box of claim 1, wherein the engaging portion is a bolt portion, the engaging portion having a male thread.

3. The mobile cooling box of claim 1, wherein the pin module further comprises a backing plate between the hinge pin and the engaging portion, the backing plate being positioned in a plane perpendicular to the longitudinal axis of the hinge pin and the backing plate having a pin-side surface and a bolt-side surface.

4. The mobile cooling box of claim 3, wherein the backing plate has a circular shape.

5. The mobile cooling box of claim 3, wherein the backing plate abuts with its bolt-side surface against said vertical surface of the box main body.

6. The mobile cooling box of claim 5, wherein said vertical surface of the box main body has a pin module attachment portion comprising a bore, in which the engaging portion is fastened, and a recess for accommodating the backing plate.

7. The mobile cooling box of claim 6, wherein the recess has a depth corresponding to the thickness of the backing plate, so that a transition from said vertical surface of the box main body to a surface of the pin-side surface of the backing plate is flush.

8. The mobile cooling box of claim 1, wherein the pin module is mounted to the box main body at a vertical surface thereof.

9. The mobile cooling box of claim 1, wherein the hinge pin has a tool engagement portion at its front end for fastening the pin module.

10. The mobile cooling box of claim 9, wherein the tool engagement portion is a hexagonal socket located at the front end face of the hinge pin, and the hinge pin has a smooth outer surface of a cylindrical shape.

11. The mobile cooling box of claim 1, wherein the pin module including the hinge pin, a backing plate and the engaging portion is formed of metal as one single and integral component.

12. The mobile cooling box of claim 1, wherein the bearing module is present at the at least one lid and the pin module is present at the box main body and further in that the hinge bearing only partly envelops the hinge pin and is open in a direction perpendicular to the longitudinal axis of the hinge pin so that the bearing module allows the hinge pin to be released from the hinge bearing, thereby enabling the at least one lid to be removed completely from the box main body.

13. The mobile cooling box of claim 12, wherein the bearing module is designed and configured so that the at least one lid cannot be removed from the box main body when the mobile cooling box is closed.

14. The mobile cooling box of claim 12, wherein the bearing module further comprises a spring element configured to hold the hinge pin in place and to provide a resistance when removing the at least one lid from the box main body.

15. The mobile cooling box of claim 12, wherein the bearing module further comprises an abutting portion, wherein the abutting portion, when the at least one lid is pivoted open for a predetermined angle of more than 90°, abuts against a region of the box main body, thereby enabling the at least one lid to rest in an open position.

16. The mobile cooling box of claim 1, said at least one lid being rectangular and having a long dimension and a short dimension.

17. The mobile cooling box of claim 16, said ends of said at least one lid being along said long dimension or said short dimension.

18. A mobile cooling box comprising:

a box main body and at least one lid for opening the box and providing access to the inside of the box, the at least one lid being pivotally attached to the box main body by at least two hinge modules, wherein each hinge module of said at least two hinge modules comprises a pin module having a hinge pin with a front end, a rear end, a longitudinal axis about which the at least one lid is pivotable and predominantly a smooth outer surface of a cylindrical shape, each said pin module having a circular backing plate;

wherein each of said at least two hinge modules further comprises a bearing module having a hinge bearing accommodating the hinge pin, wherein the hinge pin laterally extends with its front end into the hinge bearing, so that during pivoting the at least one lid with respect to the box main body an axis of the hinge bearing remains co-linear with the longitudinal axis of the hinge pin, and wherein the pin module further comprises an engaging portion extending from the rear end of the hinge pin and having a longitudinal axis being co-linear to that of the hinge pin so that the pin module is mountable by the engaging portion.

19. A mobile cooling box comprising:

a box main body and at least one lid for opening the box and providing access to the inside of the box, the at least one lid being pivotally attached to the box main body by at least two hinge modules, wherein each hinge module of said at least two hinge modules comprises a pin module having a hinge pin with a front end, a rear end, a longitudinal axis about which the at least one lid is pivotable and predominantly a smooth outer surface of a cylindrical shape, wherein each said hinge module further comprises a bearing module having a hinge bearing accommodating the hinge pin, wherein the hinge pin laterally extends with its front end into the hinge bearing, so that during pivoting the at least one lid with respect to the box main body an axis of the hinge bearing remains co-linear with the longitudinal axis of the hinge pin, wherein the pin module further comprises an engaging portion extending from the rear end of the hinge pin and having a longitudinal axis being co-linear to that of the hinge pin so that the pin module is mountable by the engaging portion, and wherein the engaging portion of a bolt with a male thread.

* * * * *